US010005285B2

(12) United States Patent
Zhou et al.

(10) Patent No.: US 10,005,285 B2
(45) Date of Patent: Jun. 26, 2018

(54) INK CARTRIDGE CHIP APPLIED IN INK CARTRIDGE, INK CARTRIDGE, AND INK CARTRIDGE ADAPTER

(71) Applicant: APEX MICROELECTRONICS CO., LTD., Guangdong (CN)

(72) Inventors: Wei Zhou, Guangdong (CN); Juhui Li, Guangdong (CN); Hao Chen, Guangdong (CN); Yanhui Luo, Guangdong (CN)

(73) Assignee: APEX MICROELECTRONICS CO., LTD., Guangdong (CN)

( * ) Notice: Subject to any disclaimer, the term of this patent is extended or adjusted under 35 U.S.C. 154(b) by 0 days. days.

(21) Appl. No.: 15/417,311

(22) Filed: Jan. 27, 2017

(65) Prior Publication Data

US 2017/0136775 A1 May 18, 2017

Related U.S. Application Data

(63) Continuation of application No. 14/784,624, filed as application No. PCT/CN2014/075412 on Apr. 15, 2014, now Pat. No. 9,592,676.

(30) Foreign Application Priority Data

Jul. 11, 2013 (CN) ..... 2013 1 0303587
Sep. 17, 2013 (CN) ..... 2013 1 0424805

(51) Int. Cl.
*B41J 2/175* (2006.01)

(52) U.S. Cl.
CPC ..... *B41J 2/17546* (2013.01)

(58) Field of Classification Search
CPC ..... B41J 2/17546; B41J 2/17543
See application file for complete search history.

(56) References Cited

U.S. PATENT DOCUMENTS 5,318,597 A * 6/1994 Hauck ..... A61N 1/36521 607/20
6,097,405 A 8/2000 Lo
(Continued)

FOREIGN PATENT DOCUMENTS

CN 1883954 12/2006
CN 101716855 6/2010
(Continued)

OTHER PUBLICATIONS

Japanese Office Action isued in Application No. JP 2016-512204, dated Nov. 8, 2016, 8 pages.
(Continued)

*Primary Examiner* — Jason Uhlenhake
(74) *Attorney, Agent, or Firm* — RatnerPrestia

(57) ABSTRACT

The application provides an ink cartridge chip applied in an ink cartridge which is detachably installed in an imaging device. The ink cartridge chip includes an interface unit and a control unit. The interface unit receives a light control command from the imaging device, which may be a light-lighting-up or a light-extinguishing command. The control unit is connected to a light-emitting unit, and lights up the light-emitting unit on detecting that the ink cartridge chip is in a power-up initialization stage. And the control unit is also connected to the interface unit, and determines, in a case that the light control command is a light-extinguishing command, whether a preset extinguishing condition is satisfied, extinguishes the light-emitting unit if the preset extinguishing condition is satisfied, and maintains a current state of the light-emitting unit if the light control command is a light-lighting-up command.

20 Claims, 12 Drawing Sheets

(56) References Cited

U.S. PATENT DOCUMENTS

| | | | | |
|---|---|---|---|---|
| 6,351,621 | B1 | 2/2002 | Richards | |
| 7,232,209 | B2 | 6/2007 | Asauchi | |
| 7,286,249 | B2 | 10/2007 | Engel | |
| 7,905,565 | B2 | 3/2011 | Kitabatake | |
| 9,108,419 | B2 | 8/2015 | Chen | |
| 2004/0150705 | A1 | 8/2004 | Kitabatake | |
| 2004/0203413 | A1 | 10/2004 | Harumoto | |
| 2005/0179750 | A1 | 8/2005 | Hayasaki | |
| 2005/0219303 | A1 | 10/2005 | Matsumoto | |
| 2006/0114276 | A1* | 6/2006 | Ohashi | B41J 2/17546 347/5 |
| 2006/0244795 | A1 | 11/2006 | Hayasaki | |
| 2008/0106757 | A1 | 5/2008 | Asauchi | |
| 2010/0141715 | A1 | 6/2010 | Swartz | |
| 2011/0216112 | A1* | 9/2011 | Ogawa | B41J 2/195 347/7 |
| 2014/0307015 | A1 | 10/2014 | Nie | |

FOREIGN PATENT DOCUMENTS

| | | | |
|---|---|---|---|
| CN | 201645986 | | 11/2010 |
| CN | 102145585 | | 8/2011 |
| CN | 102285242 | | 12/2011 |
| CN | 202093324 | | 12/2011 |
| CN | 202106686 | | 1/2012 |
| CN | 202242337 | | 5/2012 |
| CN | 202264492 | | 6/2012 |
| CN | 101596810 | | 9/2012 |
| CN | 202412919 | | 9/2012 |
| CN | 102744970 | | 10/2012 |
| CN | 102950901 | A | 3/2013 |
| CN | 102950902 | | 3/2013 |
| CN | 203004519 | | 6/2013 |
| CN | 203004525 | | 6/2013 |
| CN | 203004526 | | 6/2013 |
| CN | 203004527 | | 6/2013 |
| CN | 103182849 | | 7/2013 |
| CN | 103465632 | | 12/2013 |
| CN | 103832077 | | 6/2014 |
| EP | 1190859 | | 3/2002 |
| EP | 1736318 | A2 | 12/2006 |
| EP | 1857285 | | 11/2007 |
| EP | 2233301 | | 9/2010 |
| EP | 2735447 | | 5/2014 |
| JP | 04275156 | | 9/1992 |
| JP | 11286119 | | 10/1999 |
| JP | 2002014870 | | 1/2002 |
| JP | 2004050433 | | 2/2004 |
| JP | 3537564 | | 6/2004 |
| JP | 2005205886 | | 8/2005 |
| JP | 2006142832 | | 6/2006 |
| JP | 2006231631 | | 9/2006 |
| JP | 2007331254 | | 12/2007 |
| JP | 2009006680 | | 1/2009 |
| JP | 2010228374 | | 10/2010 |
| JP | 318477 | | 6/2013 |
| JP | 2014104755 | | 6/2014 |
| WO | 0043932 | | 7/2000 |

OTHER PUBLICATIONS

European Search Report dated Apr. 14, 2014 for European Application No. 13179119.6, 11 pages.

Non Final Office Action dated Dec. 16, 2014 for U.S. Appl. No. 13/958,496, 9 pages.

International Search Report issued in PCT Application No. PCT/CN2014/075412, dated Jul. 15, 2014, 2 pages.

Non Final Office Action for U.S. Appl. No. 14/784,624, dated May 27, 2016, 12 pages.

Notice of Allowance for U.S. Appl. No. 14/784,624, dated Nov. 4, 2016, 5 pages.

Extended European Search Report for European Application No. 14822749.9, dated Nov. 28, 2017, 8 pages.

* cited by examiner (A)

(B)

INK CARTRIDGE CHIP APPLIED IN INK CARTRIDGE, INK CARTRIDGE, AND INK CARTRIDGE ADAPTER

The present application is a U.S. Continuation application of U.S. patent application Ser. No. 14/784,624, filed on Oct. 15, 2015, which is the U.S. National Phase Application of PCT International Application No. PCT/CN2014/075412, titled "INK CARTRIDGE CHIP, INK CARTRIDGE, AND INK CARTRIDGE ADAPTIVE FRAME," filed on Apr. 15, 2014 which claims priority to Chinese Patent Application No. 201310303587.9, titled "INK CARTRIDGE CHIP AND INK CARTRIDGE WITH THE CHIP", filed on Jul. 11, 2013, and claims priority to Chinese Patent Application No. 201310424805.4, titled "INK CARTRIDGE CHIP, INK CARTRIDGE, AND INK CARTRIDGE ADAPTER", filed on Sep. 17, 2013, with the Chinese State Intellectual Property Office. All of the afore-mentioned patent applications are hereby incorporated by reference in their entireties.

FIELD

The disclosure relates to the field of printing and imaging, and particularly to an ink cartridge chip applied in an ink cartridge, an ink cartridge, and an ink cartridge adapter.

BACKGROUND

Imaging devices, such as printer, copy machine and fax machine, are common tools in the work and life of people today. An imaging device generally includes two parts, i.e., a main body and an ink cartridge. The ink cartridge, as a consumable, is usually detachably installed in the main body of the imaging device and may be replaced easily.

In a conventional imaging device, a plurality of ink cartridges may be provided for the sake of long time use, or ink cartridges with various colors may be provided to meet users' demand for different colored images. To ensure correct install location of each ink cartridge, the technology for detecting location of ink cartridge is proposed.

The technology for detecting location of ink cartridge may be realized based on the emission and receiving of light. A light source may be provided on the chip of the ink cartridge, and a light receiver may be provided in the main body of the imaging device. For detecting the location of a certain ink cartridge, the ink cartridge is placed at a location facing the light receiver, and the light source on the chip is controlled to emit light, then the receiver receives the light and detects and records the amount of light. Then, the adjacent ink cartridge(s) is(are) controlled to emit light, and the receiver receives the light, detects and records the amount of light. Since the receiver faces the ink cartridge under detection, the amount of light received from the ink cartridge under detection is greater than the amount of light received from the adjacent ink cartridge(s), and the amount of light received from the ink cartridge under detection is greater than a preset threshold. Accordingly, the main body of the imaging device may identify that the location of the ink cartridge is correct.

However, the conventional ink cartridge chips have the characteristics that: in a case that several ink cartridge chips are installed in an imaging device, light sources controlled by these ink cartridge chips emit light simultaneously, i.e., if all the ink cartridges installed in the imaging device are provided with such ink cartridge chips, it can be seen that light sources on all the ink cartridges are lighted up simultaneously and extinguished simultaneously at any time.

Since in the technology for detecting location of ink cartridge the amount of light received by the light receiver from the light source on the ink cartridge is used to detect the location of the ink cartridge, the characteristics that the conventional ink cartridge chips are lighted up simultaneously keeps the amount of light received by the light receiver constant, so that conventional ink cartridge chips are not able to detect the location of ink cartridge.

SUMMARY

To implement the detection with regard to ink cartridge location in an imaging device, an ink cartridge chip, an ink cartridge and an ink cartridge adapter are provided according to the disclosure.

An ink cartridge chip is provided according to the disclosure, wherein the ink cartridge chip comprises an interface unit, a control unit, and a storage unit;

the interface unit, is configured to receive a light control command sent from the imaging device, and the light control command comprises the ink cartridge identification information;

the storage unit, is configured to store the autogenic identification information and a state flag, and the state flag comprises an executable state or a non-executable state;

the control unit is connected to any light-emitting unit, and is configured to execute the light control command, wherein a type of the light control command comprise a light-lighting-up command or a light-extinguishing command;

the control unit is connected to the interface unit and storage unit, and is configured to, when the interface unit receives the light control command, control the light-emitting unit to execute the light control command based on the type of the light control command and the state flag in the storage unit; after the light-emitting unit executes the light control command, to re-determined the state flag based on the association relationship between the ink cartridge identification information and the autogenic identification information.

Preferably, the storage unit, is further configured to store light-emitting setting information, the light-emitting setting information comprises a correspondence relationship between a counting result and control information, and the control information comprises lighting-up forbidden and lighting-up enabled information;

accordingly, the control module is configured to, in a case that the interface unit receives the light control command, obtain a current counting result, wherein the current counting result is obtained by counting a preset counting object; obtain control information corresponding to the current counting result from the light-emitting setting information; control the light-emitting unit based on the type of the light control command and the control information; determine whether the type of the light control command is the same as the preset counting object, wherein the counting object is the light-lighting-up command or the light-extinguishing command; and determine whether to increase the current counting result by 1 based on the association relationship between the ink cartridge identification information and the autogenic identification information, in a case that the type of the light control command is the same as the counting object.

Preferably, the control unit comprises an command identifying module, an ink cartridge identifying module, a match counter and a light-emitting switch module;

the command identifying module, is configured to identify the type of the light control command received by the interface unit;

the light-emitting switch module, is configured to, in a case that the light control command identified by the command identifying module is the light-lighting-up command, obtain the current counting result, obtain control information corresponding to the current counting result from the light-emitting setting information in the storage unit, and control the light-emitting unit to execute the control information;

the ink cartridge identifying module, is configured to determine whether the ink cartridge identification information is associated with the autogenic identification information;

the match counter, is configured to, in a case that the ink cartridge identification information is associated with the autogenic identification information, increase the current counting result by 1.

Preferably, the storage unit is further configured to store a command receiving flag, the command receiving flag is used to mark a functional status of the light-emitting switch module, and the functional status is an available status or an unavailable status.

Preferably, in a case that the command receiving flag indicates that the light-emitting switch module is available, the light-emitting switch module, is configured to, if the light control command identified by the command identifying module is the light-lighting-up command, obtain the current counting result, obtain the control information corresponding to the current counting result from the light-emitting setting information in the storage unit, and control the light-emitting unit to execute the control information.

Preferably, the light-emitting setting information is determined based on light detection characteristics of the imaging device and installation location of the ink cartridge chip.

Preferably, the control unit, is further configured to, when the ink cartridge chip is powered, control the light-emitting unit to execute the light-lighting-up command if it is detected the ink cartridge chip is in a power-up initialization stage.

Preferably, the light-emitting unit is provided on the ink cartridge chip.

An ink cartridge is further according to the disclosure, wherein the ink cartridge comprises at least one of any of the above ink cartridge chips.

Preferably, the ink cartridge chip is connected to the imaging device by a communication bus.

An ink cartridge is provided according to the disclosure, wherein the ink cartridge comprises an interface unit, a control unit, and a storage unit;

the interface unit, is configured to receive light control commands sent from the imaging device, and the light control command comprises the ink cartridge identification information;

the storage unit, is configured to store the autogenic identification information and the state flag, and the state flag comprises an executable state or a non-executable state;

the control unit is connected to any light-emitting unit, and is configured to execute the light control command, wherein the type of the light control command comprises a light-lighting-up command or a light-extinguishing command;

the control unit is connected to the interface unit and storage unit, and is configured to, when the interface unit receives the light control command, control the light-emitting unit to execute the light control command based on the type of the light control command and the state flag in the storage unit; after the light-emitting unit executes the light control command, to re-determined the state flag based on the association relationship between the ink cartridge identification information and the autogenic identification information.

Preferably, the ink cartridge adapter comprises an interface unit, at least one control unit, at least one storage unit and at least one light-emitting unit;

the interface unit, is configured to receive the light control command sent from the imaging device, and the light control command comprises ink cartridge identification information;

the storage unit, is configured to storage autogenic identification information and a state flag, and the state flag comprises an executable state or a non-executable state;

the control unit is connected to the light-emitting unit, and is configured to execute the light control command, wherein the type of the light control command comprises a light-lighting-up command or a light-extinguishing command;

the control unit is connected to the interface unit and storage unit, and is configured to, when the interface unit receives the light control command, control the light-emitting unit to execute the light control command based on the type of the light control command and the state flag in the storage unit; after the light-emitting unit executes the light control command, to re-determined the state flag based on the association relationship between the ink cartridge identification information and the autogenic identification information.

Preferably, the ink cartridge adapter comprises one interface unit, one control unit, one storage unit and at least one light-emitting unit;

the control unit, is specifically configured to, when the interface unit receives the light control command, control the light-emitting unit corresponding to the light control command to execute the light control command based on the type of the light control command and the state flag in the storage unit; after the light-emitting unit executes the light control command, to re-determined the state flag based on the association relationship between the ink cartridge identification information and the autogenic identification information.

Preferably, the number of the control units, storage units and light-emitting units in the ink cartridge adapter are the same, and there is a one-to-one correspondence relationship among the control units, storage units and light-emitting units;

the control unit is connected to the corresponding light-emitting unit, and is configured to execute the light control command, wherein the type of the light control command comprises a light-lighting-up command or a light-extinguishing command;

the control unit is connected to the interface unit and the storage unit which correspond to the control unit, and is configured to, when the interface unit receives the light control command, control the light-emitting unit corresponding to the control unit to execute the light control command based on the type of the light control command and the state flag in the storage unit; after the light-emitting unit executes the light control command, to re-determined the state flag based on the association relationship between the ink cartridge identification information and the autogenic identification information.

An ink cartridge chip is provided according to the disclosure, wherein the ink cartridge chip comprises an interface unit, a control unit, and a storage unit; the interface unit is configured to receive the light control command sent from the imaging device, and the light control command comprises the ink cartridge identification information; the storage unit, is configured to store the autogenic identification information and the state flag, and the state flag comprises an executable state or a non-executable state; the control unit is connected to any light-emitting unit, and is configured to execute the light control command, wherein the type of the light control command comprises a light-lighting-up command or a light-extinguishing command; the control unit, is configured to, when the interface unit receives the light control command, control the light-emitting unit to execute the light control command based on the type of the light control command and the state flag in the storage unit; after the light-emitting unit executes the light control command, to re-determined the state flag based on the association relationship between the ink cartridge identification information and the autogenic identification information. The detection with regard to ink cartridge location in the imaging device can be implemented using the ink cartridge chip in the disclosure.

BRIEF DESCRIPTION OF THE DRAWINGS

In order to illustrate the technical solution of the embodiments of the disclosure more clearly, drawings required in the description of the embodiments will be introduced briefly hereinafter. Apparently, the drawings in the following description are just some embodiments of the disclosure. For those skilled in the art, other drawings can be obtained according to the provided drawings without any creative work.

DETAILED DESCRIPTION

The technical solution according to the embodiments of the disclosure will be described clearly and completely in conjunction with the drawings hereinafter. Apparently, the described embodiments are just a few rather than all of the embodiments of the disclosure. All other embodiments obtained by those skilled in the art based on the embodiments of the disclosure without any creative work will fall within the protection scope of the disclosure.

To make the objectives, technical solutions and merits of the disclosure more clearly, the embodiments of the disclosure are illustrated in detail hereinafter in conjunction with the drawings.

First, taking a conventional ink-jet printer for example, a typical solution for detecting location of ink cartridge is as follows.

Figure 1A:
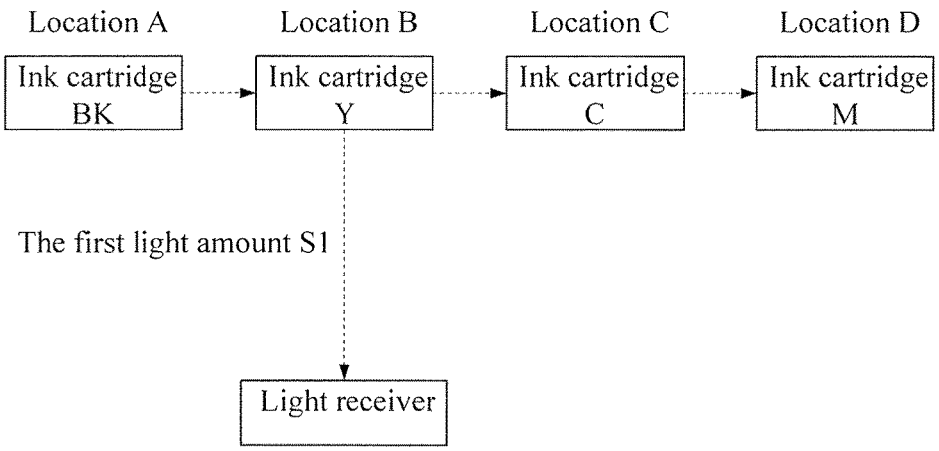
FIG. 1*a* is a diagram illustrating principle for detecting location of ink cartridge, which is applicable to an embodiment of the disclosure.
Figure 1B:
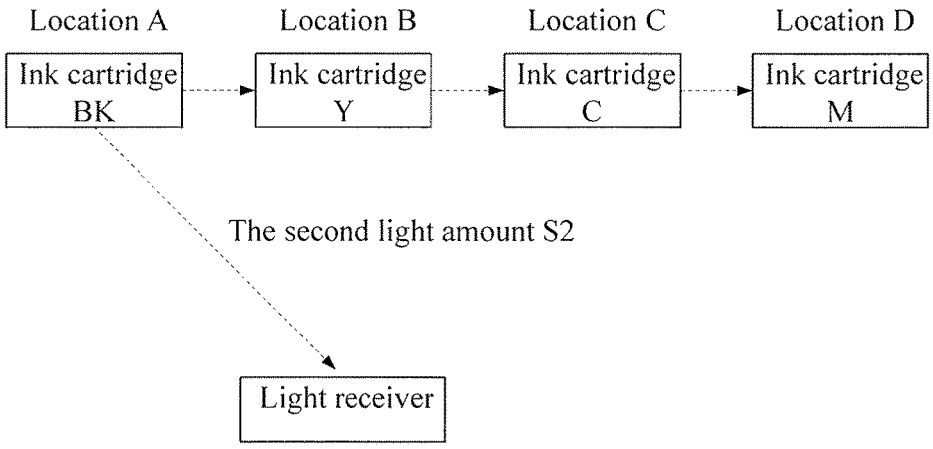
FIG. 1*b* is a diagram illustrating principle for detecting location of ink cartridge, which is applicable to an embodiment of the disclosure.

To ensure the normal print of an ink-jet printer, and prevent the print deviation caused by an error in installation location of an ink cartridge, it usually requires detecting whether the ink cartridge is installed at a correct location in the ink-jet printer correctly after the ink cartridge is put into the ink-jet printer. FIG. 1*a* and FIG. 1*b* are diagrams illustrate principle for detecting location of ink cartridge according to the embodiments of the disclosure. As shown in FIG. 1*a*, supposing four ink cartridges are provided in the ink-jet printer, which are marked as ink cartridge BK, ink cartridge Y, ink cartridge C, and ink cartridge M respectively for clear description. Respective ink cartridges are installed at the ink cartridge installation locations in the ink-jet printer, wherein the ink cartridge installation locations are location A, location B, location C, and location D respectively. The four ink cartridges are connected to the ink-jet printer by a communication bus, and each ink cartridge may receive light-emitting driving information which is sent from the ink-jet printer to any ink cartridge. As shown in FIG. 1*a* and FIG. 1*b*, a light receiver is provided on the ink-jet printer at a fixed location, and all ink cartridges are located on a carriage unit. The ink cartridges are moved by moving the carriage unit, thus the relative location between a light-emitting unit on the ink cartridge and the light receiver of the printer is changed.

The detection with regard to ink cartridge location mainly includes detection with regard to a facing location of a current ink cartridge under detection and detection with regard to adjacent light from an adjacent ink cartridge, and it requires detecting each ink cartridge in the imaging device as the ink cartridge under detection one by one. The detection with regard to facing location refers to the process that the printer drives the light-emitting unit of the ink cartridge under detection facing the light receiver to emit light, and detects whether the amount of light received by the light receiver is greater than a preset value. The detection with regard to adjacent light refers to the process that the ink cartridge under detection is kept in the location facing the light receiver, the printer drives the light-emitting unit of any ink cartridge adjacent to the ink cartridge under detection to emit light, and detects whether the amount of light received by the light receiver at this time is lower than the amount of light received in the detection with regard to facing location. As shown in FIG. 1*a*, for ink cartridge Y under detection, ink cartridge Y is moved to a location facing the light receiver, the light-emitting unit of ink cartridge Y under detection is controlled to emit light, the light receiver receives the light and acquires a first light amount S1, and it is determined whether the first light amount S1 is greater than the preset threshold. In case of positive determination, the detection with regard to facing location of the ink cartridge under detection is passed. As shown in FIG. 1*b*, the location of the ink cartridge remains unchanged, the light-emitting unit of ink cartridge BK adjacent to ink cartridge Y under detection is controlled to emit light, the light receiver receives the light and acquires a second light amount S2, and it is determined whether the second light amount S2 is lower than the preset threshold. In case of positive determination, the detection with regard to adjacent light of ink cartridge Y under detection is passed. Otherwise, the detection with regard to facing location or detection with regard to adjacent light is determined to be an error. Only in a case that both of the detections are passed, the location of the ink cartridge is deemed to be correct. The above-mentioned ink cartridge under detection should be understood as the ink cartridge on which the detection with regard to facing location is to be performed, and the adjacent ink cartridge should be understood as any ink cartridge adjacent to the above-mentioned ink cartridge under detection. In a case that the ink cartridge under detection is ink cartridge BK, ink cartridge BK is moved to a location facing the light receiver, and ink cartridge Y becomes the adjacent ink cartridge. The printer drives the light-emitting unit of ink cartridge Y to emit light at this time, and this is the detection with regard to adjacent light for ink cartridge BK. Since ink cartridge Y is at a location adjacent to ink cartridge BK under detection, it may also be deemed to be the detection with regard to adjacent location for ink cartridge Y at this time. As a general rule, the printer performs detection with regard to facing location and detection with regard to adjacent location each for once for a same ink cartridge.

The First Embodiment

Figure 2:
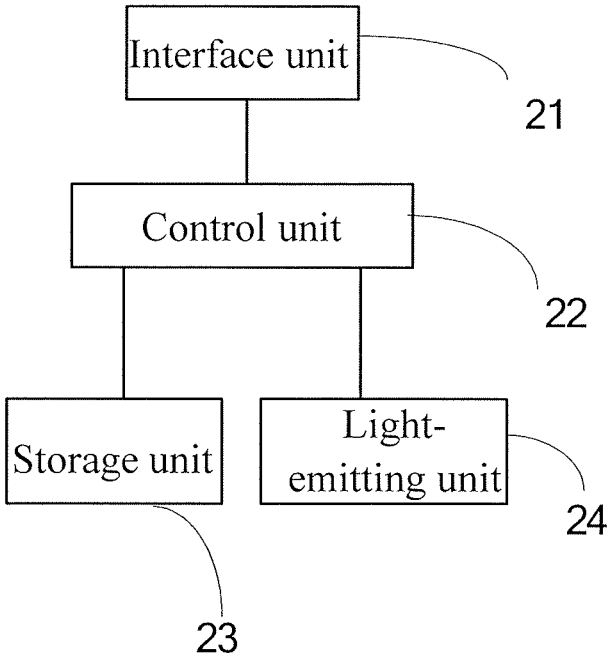
FIG. 2 is a structure diagram of an ink cartridge chip according to a first embodiment of the disclosure.

Referring to FIG. 2, FIG. 2 is a structure diagram of an ink cartridge chip according to the embodiment of the disclosure. The ink cartridge chip includes an interface unit 21, a control unit 22, and a storage unit 23. The control unit 22 is connected to a light-emitting unit 24.

The interface unit 21 is configured to receive a light control command sent by an imaging device, and the light control command includes ink cartridge identification information.

In the embodiment, the light control command includes ink cartridge identification information for identifying the ink cartridge, which may be also used to distinguish ink cartridges with different colors of ink. Meanwhile, the light control command further includes command information for indicating to light-up or extinguish the light-emitting unit. The light control command includes two types of commands, i.e., a light-lighting-up command and a light extinguishing command, the command information that the light extinguishing command includes is to extinguish the light-emitting unit, and the command information that the light-lighting-up command includes is to light-up the light-emitting unit. In addition, the interface unit may be connected to the imaging device by wired or wireless mode.

The storage unit 23, is configured to store autogenic identification information and a state flag, and the state flag includes an executable state and a non-executable state.

In the embodiment, the storage unit may store information related to the ink cartridge. The information related to the ink cartridge may be identification information of the ink cartridge itself, ink cartridge manufacturer, manufacturing date, the amount of used ink and residual ink, etc., and the identification information of the ink cartridge itself may be ink color, device address of the storage unit, or other information which may be used to distinguish different ink cartridge types. In the embodiment, the stage flag is also stored in the storage unit wherein the state flag is used to identify the executable state or non-executable state of the ink cartridge chip.

In practice, the storage unit may be common non-volatile memory, such as EPROM, EEPROM, FLASH, ferroelectric memory and phase change memory, or may be volatile memory with power supplies provided, such as SRAM+ batteries or capacitors, DRAM+ batteries or capacitors. The specific realization form of the storage unit is not limited herein.

In practice, once a condition which triggers the change of the state flag is met, the state flag in the storage unit changes, i.e., the change of the state flag may indicate that the ink cartridge chip changes from the current state to another. For example, the state flag may be represented by a 1-bit sign 'flag', and flag=0 means the current state of the ink cartridge chip is the executable state, and flag=1 means the current state of the ink cartridge chip is the non-executable state. If currently flag=1, and the condition which triggers the change of the state flag is met, the state flag 'flag' changes from flag=1 to flag=0; otherwise, flag=1 remains unchanged.

In addition, an initial default value of the state flag may indicate that the current state of the cartridge chip is the executable state, or may indicate that the current state of the cartridge chip is the non-executable state. Specifically, it may be set in advance based on light detection characteristics of different imaging devices. For example, if the imaging device performs detection with regard to facing location before detection with regard to adjacent location for the ink cartridge, the initial default value of the state flag may be set to indicate that the cartridge chip is currently in the executable state; in a case that the imaging device performs the detection with regard to adjacent location before the detection with regard to facing location on the ink cartridge, the initial default value of the state flag may be set to indicate that the cartridge chip is currently in the non-executable state.

It should be noted that, in the embodiment, the initial default value of the state flag may indicate that the state of the ink cartridge chip is the executable state, or may indicate that the state of the ink cartridge chip is the non-executable state. Specifically it may be set based on light detection characteristics of different imaging devices. In a case that the imaging device performs the detection with regard to facing location before the detection with regard to adjacent location on the ink cartridge, the initial default value of the state flag may be set to a value indicating that the ink cartridge chip is in the executable state; in a case that the imaging device performs the detection with regard to adjacent location before the detection with regard to facing location on the ink cartridge, the initial default value of the state flag may be set to a value indicating that the ink cartridge chip is in the non-executable state. The value of the state flag restores the default value when the ink cartridge chip is powered and initialized (i.e., the imaging device begins supplying the ink cartridge chip with power, and the control unit detects the power supply), or when the imaging device stops supplying the ink cartridge chip with power, or when a light control command including specific ink cartridge identification information is received.

The light-emitting unit 24 is connected to the control unit 22, and is configured to execute the light control command. Types of the light control command include the light-lighting-up command or light extinguishing command.

In embodiments of the disclosure, the light-emitting unit may be provided on the ink cartridge chip, or be connected to the control unit by a connecting component instead of being provided on the ink cartridge chip. Specifically, the connecting component may be a wire or an electrical contact, or the connection may be realized by wireless modes.

In addition, the light-emitting unit may be an electroluminescent component, specifically, may be a light emitting diode (LED), a laser diode, a fluorescent, a tungsten lamp, etc., and is not limited herein. Meanwhile, light emitted by the light-emitting unit may be visible light, or invisible light.

Those skilled in the art may understand that, the light-emitting unit in the embodiment may be provided at a location facing the light receiver directly, or at a location with a deviation, and the light may be guided to the light receiver using optical guiding components.

The control unit 22 is connected to the interface unit 21 and the storage unit 23, and is configured to, when the interface unit receives the light control command, control the light-emitting unit to execute the light control command, based on the type of the light control command and the state flag in the storage unit; after the light-emitting unit executes the light control command, to re-determined the state flag based on the association relationship between the ink cartridge identification information and the autogenic identification information.

In the embodiment, the control unit is configured to process light control commands received by the interface unit, and control to light-up the light-emitting unit or extinguish the light-emitting unit based on the type of the light control command and the state flag of the ink cartridge chip. That is to say, when the ink cartridge chip is in the executable state, the control unit may light-up the light-emitting unit based on the light-lighting-up command, and when the ink cartridge chip is in the non-executable state, the light-lighting-up command is not executed, which is equivalent to locking the light-emitting unit in the current state (i.e., maintaining an extinguished state or a lighted-up state). It can be seen that, the state flag in the embodiment is only used to indicate whether it is possible to execute the light-lighting-up command.

Specifically, once the interface unit receives the light-lighting-up command, the control unit determines whether the ink cartridge chip is in an executable state. In case of positive determination, the control unit controls to light-up the light-emitting unit, and in a case that the ink cartridge chip changes to the non-executable state, the control unit controls not to perform the operation of lighting-up the light-emitting unit; further, considering the differences among response rates of different control units, when the control unit determines that the ink cartridge chip is in the executable state, the control unit may control to light-up the light-emitting unit directly, or the control unit may control to light-up the light-emitting unit after a delay of several clock cycles (for example, 300 ms).

In addition, after the control unit determines whether the light-lighting-up command is to be executed, the state flag may be re-determined based on the association relationship between the ink cartridge identification information and the autogenic identification information, i.e., to update the state of the ink cartridge chip. Specifically, in a case that the ink cartridge identification information, included in the light-lighting-up command or light extinguishing command received by the interface unit, is associated with the autogenic identification information stored in the storage unit, the control unit changes the state flag in the storage unit, thus changes the current state of the ink cartridge. The case that the ink cartridge identification information is associated with the autogenic identification information refers to matching or homology of the information, or the information having a specific relationship, for example, a case that a same value is recorded in hexadecimal and in octal respectively may indicate an association relationship.

It should be noted that, the ink cartridge chip according to the embodiment may be connected to the imaging device by a communication bus, and in a case that the multiple ink cartridge chips shown in above embodiment all need to be connected to the imaging device, these ink cartridge chips may be connected to the imaging device by a same communication bus and receive light control commands sent from the imaging device.

Figure 3:
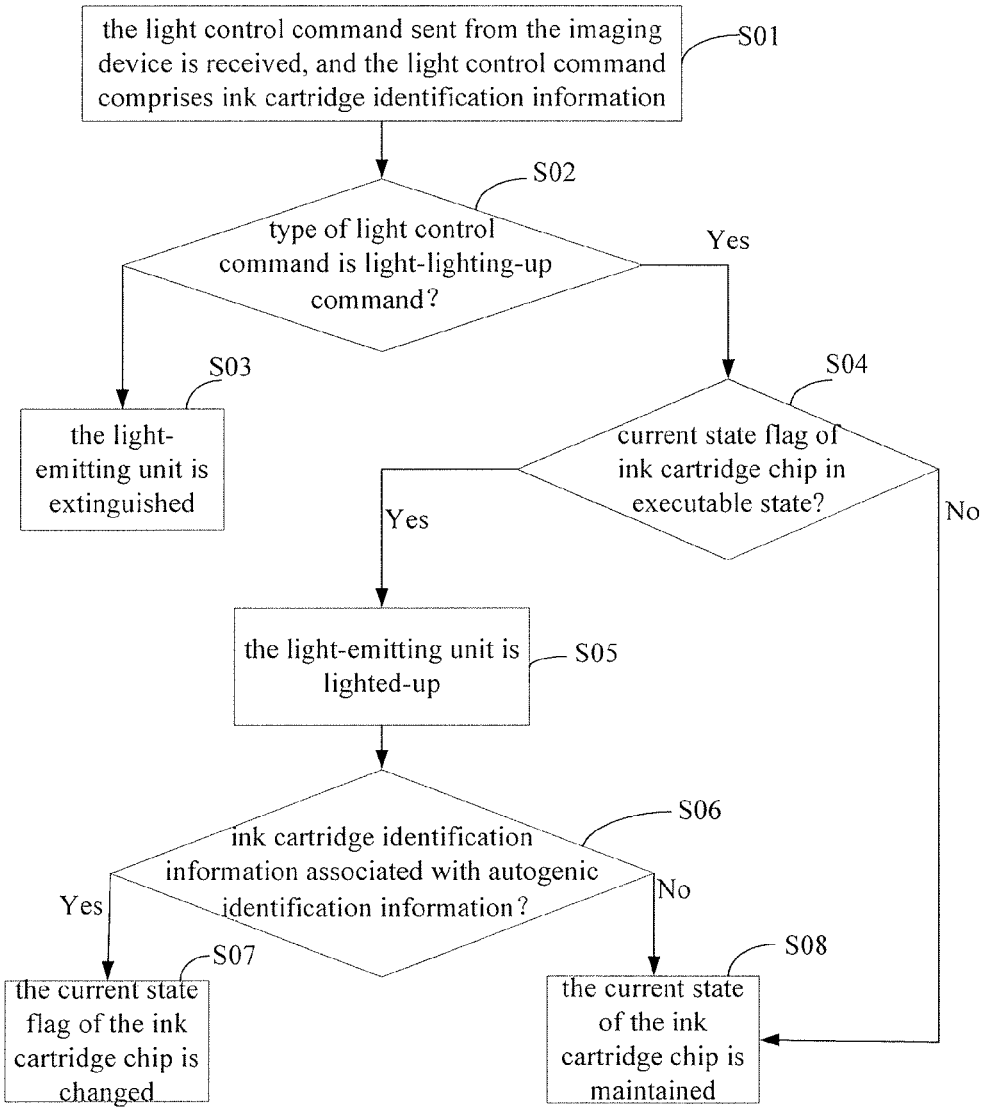
FIG. 3 is a work flowchart of an ink cartridge chip according to the first embodiment of the disclosure.

Referring to FIG. 3, FIG. 3 is a work flowchart of an ink cartridge chip according to the embodiment of the disclosure. Specifically, the flowchart includes step S01 to S08.

In step S01, the light control command sent from the imaging device is received, wherein the light control command includes ink cartridge identification information.

In step S02, it is determined whether the type of the light control command is the light-lighting-up command, and in case of positive determination, the process proceeds to step S04, otherwise the process proceeds to step S03.

Determining the light control command refers to determining the command as the light-lighting-up command or as the light extinguishing command.

In step S03, the light-emitting unit is extinguished.

In step S04, it is determined whether the current state flag of the ink cartridge chip is in an executable state; and in case of positive determination, the process proceeds to step S05, otherwise the process proceeds to step S08;

Based on the determination result about the state of the ink cartridge chip, it may be determined whether it requires to light-up the light-emitting unit. In a case that the ink cartridge chip is in the non-executable state, the light-emitting unit is not to be lighted-up; in a case that the ink cartridge chip is in the executable state, the light-emitting unit is to be lighted-up.

In step S05, the light-emitting unit is lighted-up.

In step S06, it is determined whether the ink cartridge identification information is associated with the autogenic identification information; and in case of positive determination, the process proceeds to step S07, otherwise the process proceeds to step S08.

In step S07, the current state flag of the ink cartridge chip is changed;

in a case that the current state is the executable state, the state is changed to the non-executable state; in a case that the current state is the non-executable state, the state is changed to the executable state.

In step S08, the current state of the ink cartridge chip is maintained.

Step S02 and Step S04 relates to determining the type of the light control command and the state flag of the ink cartridge chip, respectively, and in practice these two steps may be executed simultaneously, or the state of the ink cartridge chip is determined before the type of the light control command is determined. The execution sequence of these two steps does not affect the implementation of the embodiment.

In above step S06, whether the comparison is performed for the light-lighting-up command or the light extinguishing command may be determined based on characteristics of the imaging device. Since the light-lighting-up command and the light extinguishing command always come in pairs successively and corresponding ink cartridge identification information is the same, one of them may be selected for comparison, i.e., just one type of the commands may be chosen to compare with the ink cartridge identification information; in a case that only the light-lighting-up command includes corresponding ink cartridge identification information, only the ink cartridge identification information corresponding to the light-lighting-up command may be chosen to be compared with the identification information stored in the ink cartridge chip.

In addition, the ink cartridge chip according to the embodiment may light-up the light-emitting unit in advance when the ink cartridge chip is powered and the control unit detects that the ink cartridge chip is in the power-up initialization stage, rather than waiting to light-up the light-emitting unit until the light-lighting-up command from the imaging device is received. It allows the case that after the ink cartridge with the ink cartridge chip according to the embodiment is installed into the imaging device, in a case that the imaging device already supplies the ink cartridge chip with power, the light-emitting unit may emit light immediately, and the user may learn in advance through this phenomenon that the electrical contact between the ink cartridge chip and the imaging device is normal. It should be noted that this is not only advantageous in the case that the light-emitting unit emits visible light, even if the light-emitting unit emits non-visible light, for example, ultraviolet, in a case that there is fluorescent matter on the ink cartridge or imaging device where the light of light-emitting unit may reach, the ultraviolet would force the fluorescent matter to emit light, which also plays a role in prompting the user.

Figure 4:
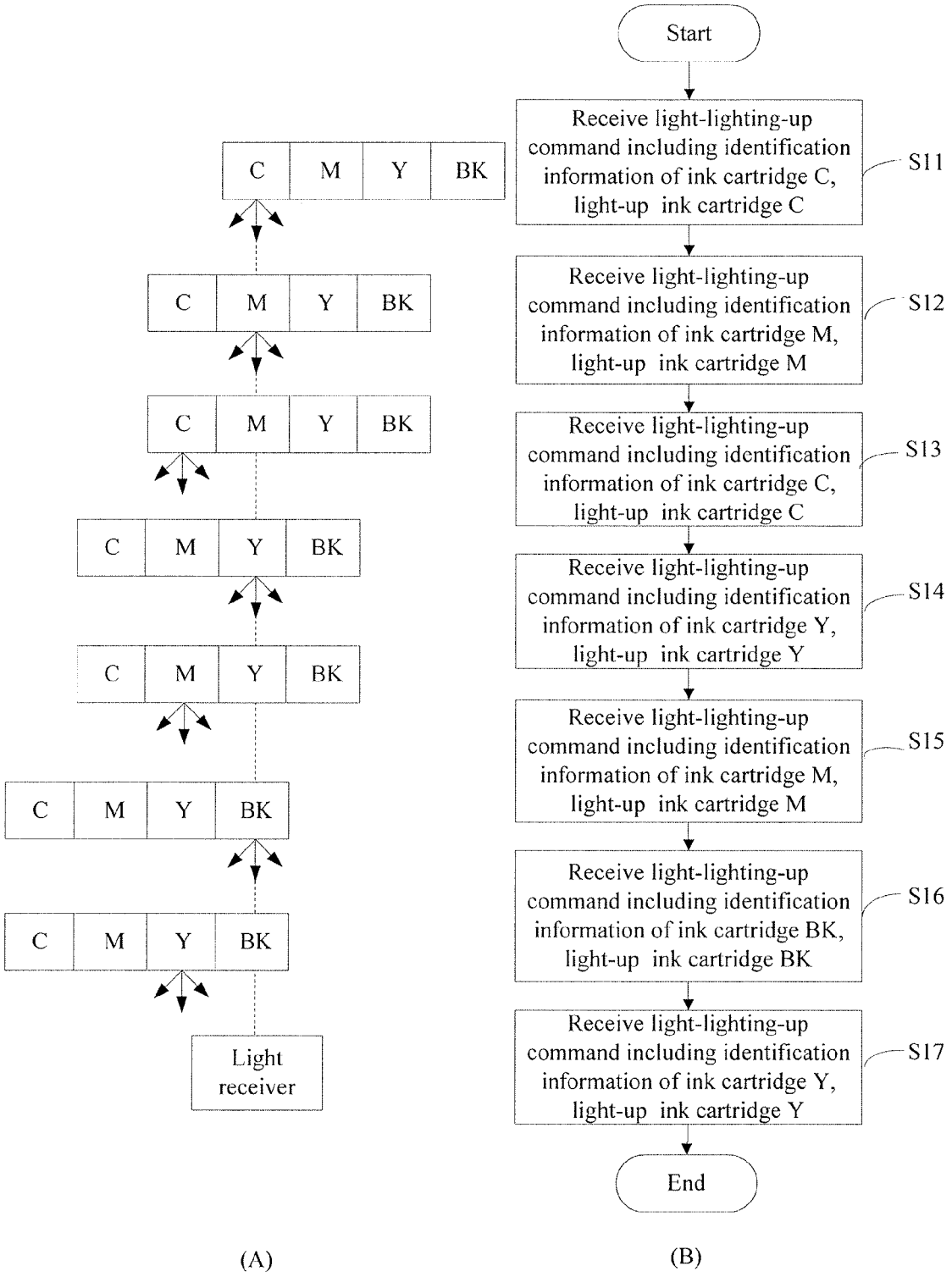
FIG. 4 is a flow chart for detecting location of ink cartridge using a conventional ink cartridge chip.
Figure 5:
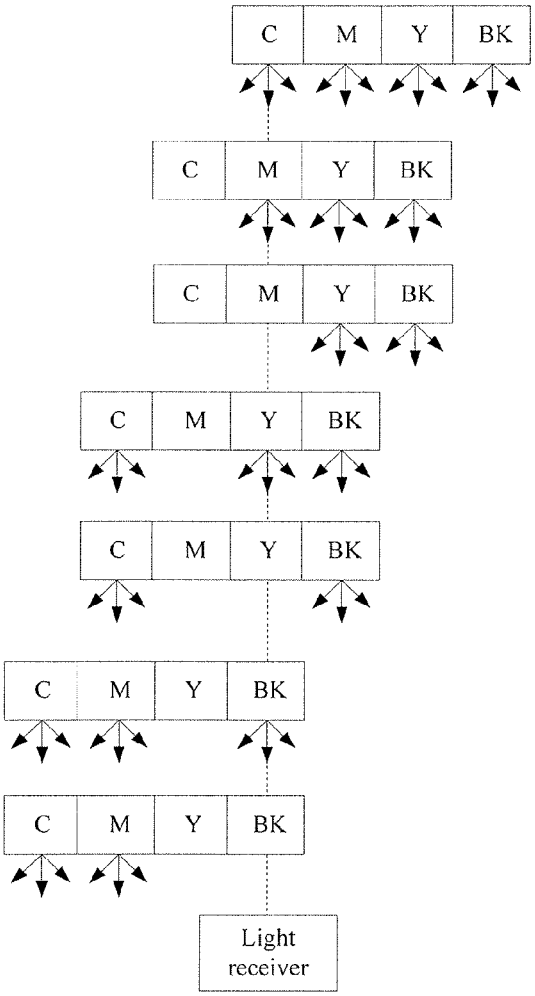
FIG. 5 is a flow chart for detecting location of ink cartridge using the ink cartridge chip according to the first embodiment of the disclosure.
Figure 5:
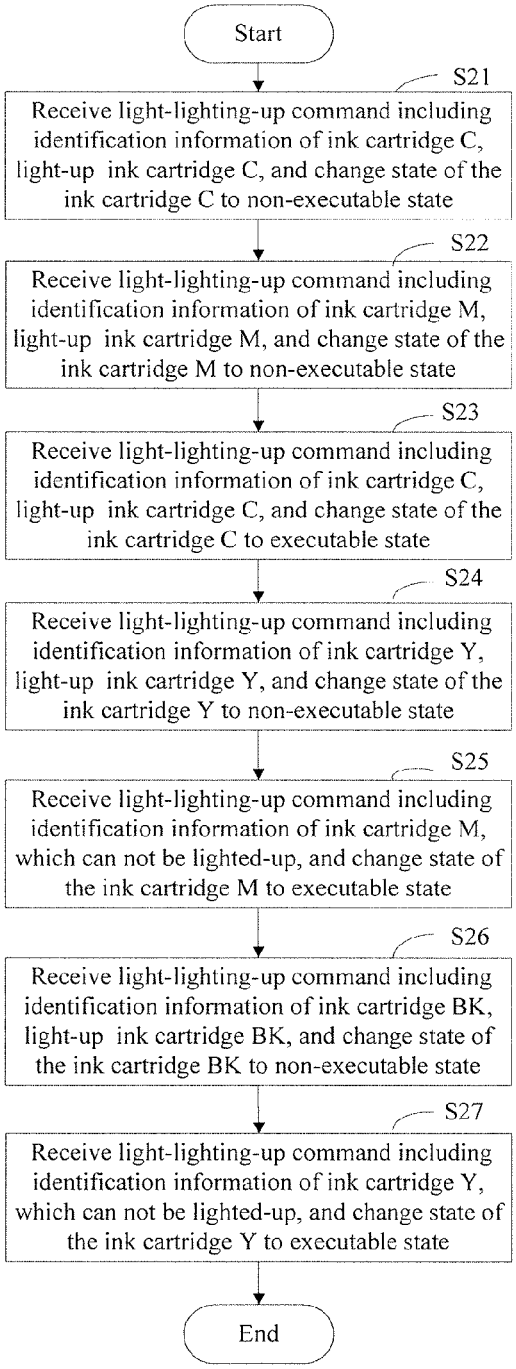

Referring to FIG. 4 and FIG. 5, FIG. 4 is a flow chart for detecting location of ink cartridge using a conventional ink cartridge chip, and FIG. 5 is a flow chart for detecting location of ink cartridge using the ink cartridge chip according to the embodiment of the disclosure. Advantages of the ink cartridge chip according to the embodiment are further illustrated by a comparison between FIG. 4 and FIG. 5.

There is a one-to-one correspondence relationship between Step S11 to S17 in FIG. 4 and Step S21 to S27 in FIG. 5, respectively. Both parts (B) in FIG. 4 and FIG. 5 are control methods for detecting ink cartridge location, and both parts (A) illustrate light-emitting phenomenon of light-emitting units. It is supposed the imaging device performs on the ink cartridge the detection with regard to facing location before the detection with regard to adjacent location.

In FIG. 4, steps S11 and S13 are steps in which the detection with regard to facing location and detection with regard to adjacent location are performed on ink cartridge C respectively. Since these four ink cartridges are connected to the imaging device by one communication bus, each ink cartridge may receive the light control command which the imaging device sends to any ink cartridge. In a case that the imaging device sends the same light-lighting-up commands carrying identification information of ink cartridge C, since the identification information of ink cartridge C is only stored in the chip of ink cartridge C, only ink cartridge C is lighted-up and the lighted state lasts for some time, then ink cartridge C is extinguished by the light extinguishing command sent by the imaging device (the effect of the light extinguishing command is not shown in FIG. 4).

Steps S12 and S15 show stages in which the detection with regard to facing location and detection with regard to adjacent location are performed on ink cartridge M respectively. In these two stages, the imaging device sends the same light-lighting-up commands carrying identification information of ink cartridge M, and similarly, only ink cartridge M is lighted-up and the lighted state lasts for some time, then ink cartridge M is extinguished by the light extinguishing command sent by the imaging device.

Steps S14 and S17 show stages in which the detection with regard to facing location and detection with regard to adjacent location are performed on ink cartridge Y respectively. In these two stages, the imaging device sends the same light-lighting-up commands carrying identification information of ink cartridge Y, thus only ink cartridge Y is lighted-up, and the lighted state lasts for some time, then ink cartridge Y is extinguished by the light extinguishing command sent by the imaging device.

Step S16 is a stage in which the detection with regard to facing location is performed on ink cartridge BK. Since ink cartridge BK is the last ink cartridge under detection, in a case that all preceding ink cartridges are installed in correct locations, ink cartridge BK is certainly installed in the correct location, thus in most cases only the detection with regard to facing location is performed on ink cartridge BK. In this stage, the imaging device sends the light-lighting-up command carrying identification information of ink cartridge BK, thus only ink cartridge BK is lighted-up and the lighted state lasts for some time, then ink cartridge BK is extinguished by the light extinguishing command sent by the imaging device.

In FIG. 5, all the initial default values of state flags of ink cartridge C, M, Y, and BK indicate that the ink cartridge chips are in the executable state. Since these four ink cartridges are connected to the imaging device by one communication bus, and each ink cartridge may receive the light control command which the imaging device sends to any ink cartridge, light-emitting units of all ink cartridges are lighted-up in step S21. And since in step S11, what the imaging device sends is the light-lighting-up command carrying identification information of ink cartridge C, only the state of ink cartridge C needs to be updated from the executable state to the non-executable state.

In step S22, except that ink cartridge C is in the non-executable state, all others are in the executable state, thus when the light-lighting-up command carrying identification information of ink cartridge M sent by the imaging device is received, ink cartridges M, Y, and BK are all lighted-up, and ink cartridge C cannot be lighted-up. Similar to above steps, then the state of ink cartridge M changes from the executable state to the non-executable state.

In step S23, ink cartridge chips of ink cartridge C and ink cartridge M are both in the non-executable state, thus when the light-lighting-up command carrying identification information of ink cartridge C sent by the imaging device is received, neither of the light-emitting units of ink cartridges C and ink cartridge M may be lighted-up, and both of the light-emitting units of ink cartridges Y and ink cartridge BK are lighted-up, then the state of ink cartridge C changes to the executable state.

In step S24, Similar to above steps, ink cartridges C, Y and BK, of which the ink cartridge chips are in the executable state, may be lighted-up, and ink cartridge M cannot be lighted-up, then the state of ink cartridge Y changes to the non-executable state.

In step S25, ink cartridges C and BK are lighted-up, and ink cartridges M and Y cannot be lighted-up. The state of ink cartridge M changes to the executable state.

In step S26, ink cartridges C, M and BK are lighted-up, and ink cartridge Y cannot be lighted-up. The state of ink cartridge BK changes to the non-executable state.

In step S27, ink cartridges C and M are lighted-up, and ink cartridges Y and BK cannot be lighted-up. The state of ink cartridge Y changes to the executable state.

It may be seen from the above comparison, in steps S21, S22, S24, and S26 of the stage of detection with regard to facing location in FIG. 5, light-emitting units of at least two ink cartridges emit light simultaneously, and the amount of light received by the light receiver in the stage of detection with regard to facing location is increased. In steps S23, S25, and S27 of the stage of detection with regard to adjacent location, compared to corresponding steps S13, S15, and S17 in FIG. 4, light-emitting units which should have been lighted-up are not lighted-up, and the amount of light received by the light receiver in the stage of detection with regard to adjacent location is reduced (if there is a further set-up on the ink cartridge structure to stop the light-emitting unit scattering light in a certain direction, there may be more reduced amount of received light). Thus, the ink cartridge chip and light-emitting control method according to the disclosure only require adding the state flag to the conventional ink cartridge chip, to reduce the false alarm rate of the imaging device caused by the manufacturing error of the light-emitting unit or ink cartridge. In addition, the difficulty for the imaging device to identify incorrect installation of multiple ink cartridges, which is the drawback of the solution in which multiple chips are lighted-up or extinguished simultaneously, is avoided.

The Second Embodiment

Some conventional imaging devices require a revolving detection before performing a light detection. Taking the arrangement of ink cartridges in FIG. 4 for example, the so-called revolving detection, refers to making the light receiver face one of the ink cartridges, and then lighting-up the light-emitting units of the ink cartridges once in turn from one direction to another, for example, from the left side, lighting-up the light-emitting units of ink cartridges C, M, Y and BK once in turn, and determining whether the light receiver receives light all the time. Ink cartridge chips according to the above embodiment may not pass the revolving detection of the imaging device, causing the imaging device to consider the ink cartridge to be unqualified or illegal. Thus, an ink cartridge chip according to the embodiment, not only passes the light detection of the imaging device, but also passes the revolving detection of the imaging device.

The ink cartridge chip according to the embodiment, having a structure similar to that of the ink cartridge chip according to the first embodiment, also includes an interface unit, a control unit, and a storage unit, wherein the control unit may be connected to any light-emitting unit and control the light-emitting unit. The connection among and existence forms of respective units in the ink cartridge chip according to the embodiment are also the same as those of the ink cartridge chip according to the first embodiment, which will not be described again here, and only the differences are presented.

Figure 6:
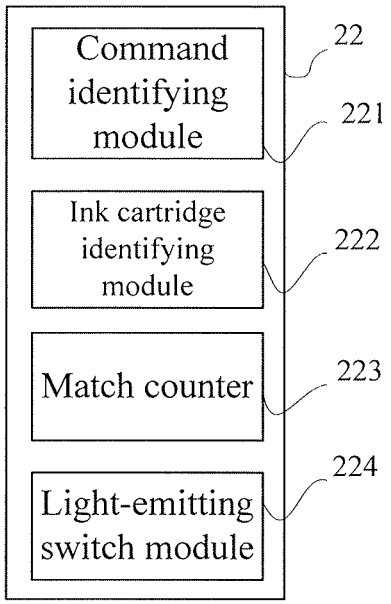
FIG. 6 is a structure diagram of a control unit in an ink cartridge chip according to a second embodiment of the disclosure.

The storage unit included in the ink cartridge chip according to the embodiment, at least stores autogenic identification information and light-emitting setting information. Meanwhile, referring to FIG. 6, FIG. 6 is a structure diagram of the control unit in the ink cartridge chip according to the embodiment. The control unit 22 includes a command identifying module 221, an ink cartridge identifying module 222, a match counter 223 and a light-emitting switch module 224.

In practice, the command identifying module, is configured to identify the type of a light control command received by the interface unit; the command identifying module is configured to identify whether the received light control command is a light extinguishing command or a light-lighting-up command; the light-emitting switch module, is configured to, in a case that the light control command identified by the command identifying module is the light-lighting-up command, obtain current counting result, obtain control information corresponding to the current counting result from the light-emitting setting information in the storage unit, wherein the control information indicates lighting-up forbidden and lighting-up enabled, and control the light-emitting unit to execute the control information; the ink cartridge identifying module, is configured to determine whether the ink cartridge identification information is associated with the autogenic identification information stored in the storage unit; the match counter, is configured to, in a case that the ink cartridge identification information is associated with the autogenic identification information, increase the current counting result by 1.

The match counter is configured to count the number of times that the light control commands associated with the ink cartridge identification information in the storage unit are received. The light-emitting switch module is configured to light-up or extinguish the light-emitting unit connected to the control unit, based on the light-emitting setting information, counting result of the match counter, and the type of the light control command.

The light-emitting setting information stored in the storage unit and the current counting result are used to indicate the state flag of the ink cartridge chip, wherein the light-emitting setting information may include the correspondence relationship between the counting result and the control information, the control information indicates lighting-up forbidden and lighting-up enabled, and the control information may further indicate releasing the light-emitting switch module. The storage unit may further store a command receiving flag for marking a functional status of the light-emitting switch module, and the functional status is an available status or an unavailable status. The command receiving flag may be configured to indicate the initialized state of the ink cartridge chip, i.e., the command receiving flag is used to record whether the ink cartridge chip receives all types of light-lighting-up commands or light-extinguishing commands during the revolving detection, for example, in a case that the ink cartridge requires to perform the revolving detection, and the ink cartridge chip receives all types of light-lighting-up commands or light-extinguishing commands during the revolving detection, the command receiving flag records the above process. When the ink cartridge chip is initialized, the initial value of the command receiving flag indicates that the ink cartridge chip does not receive all types of light-lighting-up commands or light-extinguishing commands during the revolving detection. The ink cartridge identifying module may be further configured to, in a case that the command receiving flag is at the initial value, determine whether the ink cartridge chip receives all types of light-lighting-up commands or light-extinguishing commands during the revolving detection. Correspondingly, the storage unit of the ink cartridge chip further needs to store the ink cartridge identification information of all other ink cartridges. In a case that the ink cartridge identifying module determines that the ink cartridge chip already receives all types of light-lighting-up commands or light-extinguishing commands during the revolving detection, the initial value of the command receiving flag is changed to a value indicating that all types of light-lighting-up commands or light-extinguishing commands are received. In a case that the command receiving flag is at the initial value, the light-emitting switch module is not able to light-up the light-emitting unit.

Since the light-lighting-up command and light extinguishing command corresponding to the ink cartridge identification information mostly come in pairs successively, it is possible that the ink cartridge identifying module only identifies the light-lighting-up commands and accordingly the match counter also only counts for the light-lighting-up commands; similarly, it is possible that the ink cartridge identifying module only identifies the light-extinguishing commands, and accordingly the match counter also only counts the light-extinguishing commands. Similarly, it is possible that the command receiving flag only records whether the ink cartridge chip receives all types of light-lighting-up commands during the revolving detection or only records whether the ink cartridge chip receives all types of light-extinguishing commands during the revolving detection.

The process for detecting ink cartridge location using the ink cartridge chip according to the embodiment is illustrated as follows. It is supposed that the imaging device performs the revolving detection on the ink cartridge first, then performs the light detection shown in steps S11 to S17 in FIG. 4, meanwhile the types and location sequence of the ink cartridges installed in the imaging device are the same as those of ink cartridges C, M, Y, and BK shown in FIG. 4, and the revolving detection is performed on the four ink cartridges in the sequence for sending the light control commands shown in Table 1. Finally, after finishing the revolving detection and light detection of the ink cartridge, the imaging device informs the user one or more failed ink cartridges which fail or are about to reach the end of their lives with flickering by cyclically sending light-lighting-up commands and light-extinguishing commands to the ink cartridge chips. Apparently, when informing the user the failed ink cartridges, the imaging device has to display in a precise manner.

TABLE 1

| No. | Type of Command |
|---|---|
| 1 | Light-up ink cartridge C |
| 2 | Extinguish ink cartridge C |
| 3 | Light-up ink cartridge M |
| 4 | Extinguish ink cartridge M |
| 5 | Light-up ink cartridge Y |
| 6 | Extinguish ink cartridge Y |
| 7 | Light-up ink cartridge BK |
| 8 | Extinguish ink cartridge BK |

Supposing that the match counter counts incrementally and starts at zero, in a case that the ink cartridge identifying module determines that the received ink cartridge identification information is associated with the autogenic identification information stored in the storage unit, the match counter increases the count by 1, and only counts light-lighting-up commands. Meanwhile, based on the light detection characteristics of the imaging device, light-emitting setting information in the storage units of ink cartridges C, M, and Y may be set in advance as follows:

when the count of the match counter is 0, the control information is forbidding the light-emitting switch module to light-up the light-emitting unit;

when the count of the match counter is 1, the control information is enabling the light-emitting switch module to light-up the light-emitting unit;

when the count of the match counter is 2, the control information is forbidding the light-emitting switch module to light-up the light-emitting unit;

when the count of the match counter is 3 or more than 3, the control information is releasing the function of the light-emitting switch module, and if the ink cartridge identifying module determines that the ink cartridge identification information of the received light-lighting-up command is associated with the autogenic identification information stored in the storage unit, the light-emitting switch module lights-up the light-emitting unit;

the initial value of the command receiving flag indicates that the ink cartridge chip does not receive all types of light-lighting-up commands during the revolving detection yet.

Since only the detection with regard to facing location and no detection with regard to adjacent location is performed on ink cartridge BK in step S16 in FIG. 4, compared to light-emitting setting information of other ink cartridge chips, the light-emitting setting information of ink cartridge BK indicates that the control information is releasing the function of the light-emitting switch module when the count of the match counter is 2 or more than 2.

In durations of commands No. 1 to No. 8 in the above Table 1, the light receiver faces ink cartridge C, and the revolving detection is performed on ink cartridges C, M, Y, and BK. Light-emitting units on these four ink cartridges are lighted-up and extinguished in turn.

In durations of commands No. 1 to No. 2, in a case that respective ink cartridge chips determine that the type of command No. 1 is the light-lighting-up command by the command identifying module, since the counts of the match counters of all ink cartridge chips are zero at this moment, no light-emitting units are lighted-up by the light-emitting switch module in this period based on the light-emitting setting information in the storage unit, then the ink cartridge identifying module determines that the light-lighting-up command No. 1 includes identification information of ink cartridge C, thus only the match counter of ink cartridge C increases the count by 1, and the count changes to 1. In a case that the command identifying module determines that the type of command No. 2 is the light-extinguishing command, the light-emitting switch module extinguishes the light-emitting unit without the influence of the light-emitting setting information. The ink cartridge identifying module and the match counter do not process the light-extinguishing command No. 2.

In durations of commands No. 3 to No. 4, in a case that respective ink cartridge chips determine that the type of command No. 3 is the light-lighting-up command by the command identifying module, the counts of the match counters of ink cartridges M, Y, and BK are zero, and based on the light-emitting setting information in the storage unit, light-emitting units of ink cartridges M, Y, and BK are not lighted-up by the light-emitting switch module in this period; the count of the match counter of ink cartridges C is 1, and based on the control information of the light-emitting setting information in the storage unit, the light-emitting switch module of ink cartridges C is enabled, but since the command receiving flag is still at the initial value, the light-emitting unit of ink cartridges C can still not be lighted-up. Then the ink cartridge identifying module determines that the light-lighting-up command No. 3 includes identification information of ink cartridge M, thus only the match counter of ink cartridge M increases the count by 1, and the count changes to 1. When the command identifying module determines that the type of command No. 4 is the light-extinguishing command, the light-emitting switch module extinguishes the light-emitting unit without the influence of the light-emitting setting information. The ink cartridge identifying module and the match counter do not process the light-extinguishing command No. 4.

In durations of commands No. 5 to No. 6, similarly, still no light-emitting units of ink cartridges are lighted-up. The ink cartridge identifying module determines that the light-lighting-up command No. 5 includes identification information of ink cartridge Y, the match counter of ink cartridge Y increases the count by 1, and the count changes to 1.

In durations of commands No. 7 to No. 8, similarly, still no light-emitting units of ink cartridges are lighted-up. The ink cartridge identifying module determines that the light-lighting-up command No. 7 includes identification information of ink cartridge BK, the match counter of ink cartridge BK increases the count by 1, and the count changes to 1. By this time, the match counters of respective ink cartridge chips count to 1, and ink cartridge identifying modules of respective chips already determine that all types of light-lighting-up commands during the revolving detection are received, thus command receiving flags of respective ink cartridge chips change from the initial values to values indicating that all types of light-lighting-up commands during the revolving detection are received. In a case that the command identifying module determines that the type of command No. 8 is the light-extinguishing command, the light-emitting switch module extinguishes the light-emitting unit without the influence of the light-emitting setting information. The ink cartridge identifying module and the match counter do not process the light-extinguishing command No. 8.

Thus, during the whole revolving detection, none of the light-emitting units of respective ink cartridge chips are lighted-up. After the revolving detection is finished, the imaging device begins to perform the light detection on the ink cartridge. During the light detection, same light control commands are sent by the imaging device to the ink cartridge chip in the same sequence as those in steps S11 to S17 in FIG. 4.

When the light-lighting-up command including identification information of ink cartridges C in step S11 is received, since the match counters of respective ink cartridge chips count to 1, and command receiving flags of respective ink cartridge chips change from the initial values to values indicating that all types of light-lighting-up commands during the revolving detection are received, all ink cartridge chips light-up the light-emitting units connected to the control units. Since the light-lighting-up command includes identification information of ink cartridge C, the match counter of ink cartridge C increases the count by 1, and the count changes to 2. In a case that the light-extinguishing command is received, all ink cartridges extinguish the light-emitting units.

When the light-lighting-up command including identification information of ink cartridges M in step S12 is received, the match counter of ink cartridge C already counts to 2, thus the light-emitting unit of ink cartridge C can not be lighted-up, and all others are lighted-up. Since the light-lighting-up command includes identification information of ink cartridge M, the match counter of ink cartridge M increases the count by 1, and the count changes to 2. In a case that the light-extinguishing command is received, all ink cartridges extinguish the light-emitting units.

When the light-lighting-up command including identification information of ink cartridges C in step S13 is received, both the match counters of ink cartridges C and M count to 2, thus the light-emitting units of ink cartridges C and M can not be lighted-up, and all others are lighted-up. Since the light-lighting-up command includes identification information of ink cartridge C, the match counter of ink cartridge C increases the count by 1, and the count changes to 3. When the light-extinguishing command is received, all ink cartridges extinguish the light-emitting units.

When the light-lighting-up command including identification information of ink cartridges Y in step S14 is received, the match counters of ink cartridges C and M count to 3 and 2 respectively, and based on the setup of foregoing light-emitting setting information, the light-emitting switch module is released when the match counter counts to 3, thus the light-emitting units of ink cartridges C and M can not be lighted-up, and all others are lighted-up. Since the light-lighting-up command includes identification information of ink cartridge Y, the match counter of ink cartridge Y increases the count by 1, and the count changes to 2. When the light-extinguishing command is received, all ink cartridges extinguish the light-emitting units.

When the light-lighting-up command including identification information of ink cartridges M in step S15 is received, the match counters of ink cartridges C, M and Y count to 3, 2 and 2 respectively, and based on the setup of foregoing light-emitting setting information, the light-emitting switch module is released when the match counter counts to 3, thus the light-emitting units of ink cartridges C, M and Y can not be lighted-up, and only the light-emitting unit of ink cartridge BK is lighted-up. Since the light-lighting-up command includes identification information of ink cartridge M, the match counter of ink cartridge M increases the count by 1, and the count changes to 3. When the light-extinguishing command is received, all ink cartridges extinguish the light-emitting units.

When the light-lighting-up command including identification information of ink cartridges BK in step S16 is received, the match counters of ink cartridges C, M and Y count to 3, 3 and 2 respectively, and based on the setup of foregoing light-emitting setting information, the function of the light-emitting switch module is released when the match counter counts to 3, thus the light-emitting units of ink cartridges C, M and Y can not be lighted-up, and only the light-emitting unit of ink cartridge BK is lighted-up. Since the light-lighting-up command includes identification information of ink cartridge BK, the match counter of ink cartridge BK increases the count by 1, and the count changes to 2. When the light-extinguishing command is received, all ink cartridges extinguish the light-emitting units.

When the light-lighting-up command including identification information of ink cartridges Y in step S17 is received, the match counters of ink cartridges C, M, Y and BK count to 3, 3, 2 and 2 respectively, and based on the setup of foregoing light-emitting setting information, the function of the light-emitting switch modules are released when the match counters of ink cartridges C and M count to 3 and the match counter of ink cartridge BK counts to 2, thus none of the light-emitting units of ink cartridges C, M, Y and BK can be lighted-up. Since the light-lighting-up command includes identification information of ink cartridge Y, the match counter of ink cartridge Y increases the count by 1, and the count changes to 3. When the light-extinguishing command is received, all ink cartridges extinguish the light-emitting units. It may be seen that, the light-emitting phenomenon of the light-emitting units in the embodiment is similar to the light-emitting phenomenon shown in FIG. 9 at left.

So far, match counters of all ink cartridge chips count to the respectively defined values at which the light-emitting switch modules are released, and the imaging device may perform a precise light-emitting control on a specific ink cartridge chip. Thus, after the imaging device performs the revolving detection and light detection on the ink cartridge, if it is found that an ink cartridge is installed incorrectly or an ink cartridge is about to reach the end of its life (generally refers to the case of running out of ink according to the detection), the light-emitting unit on the ink cartridge may be controlled to flicker by sending the light control command carrying identification information of the ink cartridge, to prompt the user. It may be seen that the ink cartridge and control method thereof do not influence the function of precise prompt.

It should be noted that, light-lighting-up commands sent by some imaging devices to ink cartridge chips during the revolving detection and light detection are different from light-lighting-up commands sent after the revolving detection and light detection, e.g., the light-lighting-up commands including identification information of ink cartridge C are in a same format during the revolving detection and light detection, and in another format after the revolving detection and light detection. Since the ink cartridge chip controls the light-emitting unit differently when receiving the light-lighting-up commands in two different formats, i.e., during the revolving detection and light detection, when the ink cartridge chip receives the light-lighting-up command, the light-emitting unit is driven by a constant voltage and maintains always lighting, thus the command may be called a always-lighting light-lighting-up command; after the revolving detection and light detection, when the ink cartridge chip receives the light-lighting-up command, the light-emitting unit is driven by a pulse-width modulation (PWM) voltage and flickers, thus the command may be called a flickering light-lighting-up command. Since there are significant differences between the always-lighting light-lighting-up command and flickering light-lighting-up command, it is possible that the light-emitting setting information is setup only for the always-lighting light-lighting-up command without the need for releasing the lighting-up function of the light-emitting switch module, and the ink cartridge chip may process the flickering light-lighting-up command in a manner of releasing the lighting-up function, i.e., in a case that the ink cartridge identifying module determines that the ink cartridge identification information of the received flickering light-lighting-up command is associated with the autogenic identification information stored in the storage unit, the light-emitting switch module lights-ups the light-emitting unit.

The match counter and command receiving flag in the embodiment reset to zero or restore default values when the ink cartridge chip is powered and initialized, or when the imaging device stops supplying the ink cartridge chip with power. In addition, in the embodiment, when the ink cartridge chip is powered, the control unit detects that the ink cartridge chip is in power-up initialization stage, and light-up the light-emitting unit in advance, rather than waiting until the light-lighting-up command from the imaging device is received. The advantage is: when the ink cartridge with the ink cartridge chip according to the embodiment is installed into the imaging device, and the imaging device already supplies the ink cartridge chip with power at this moment, the light-emitting unit may emit light, and the user may learn in advance through this phenomenon that the electrical contact between the ink cartridge chip and the imaging device is normal.

The Third Embodiment

The ink cartridge chip according to the embodiment, having a structure similar to that in the first embodiment, also includes an interface unit, a control unit, a storage unit, and a light-emitting unit. The connection among and existence forms of respective units of the ink cartridge chip according to the embodiment are the same as those of the ink cartridge chip according to the first embodiment, which will not be described again here, and only the differences are presented.

The storage unit of the ink cartridge chip according to the embodiment, stores at least autogenic identification information. It should be noted that, the control unit of the ink cartridge chip according to the embodiment may only execute the light-extinguishing command, and extinguishes the light-emitting unit in a case that the preset extinguishing condition is satisfied.

Specifically, when the ink cartridge chip is powered, the control unit, detecting that the ink cartridge chip is in power-up initialization stage, lights-up the light-emitting unit in advance, rather than waiting until the light-lighting-up command from the imaging device is received. The advantage is: when the ink cartridge with the ink cartridge chip according to the embodiment is installed into the imaging device, and the imaging device already supplies the ink cartridge chip with power at this moment, the light-emitting unit may emit light, and the user may learn in advance through this phenomenon that the electrical contact between the ink cartridge chip and the imaging device is normal.

Thereafter, when the control unit receives the light-lighting-up command sent from the imaging device, since the light-emitting unit is already lighted-up, the command is not executed. After some time, the imaging device sends the light-extinguishing command, and the control unit determines whether the preset extinguishing condition is satisfied after receiving the light-extinguishing command through the interface unit, i.e., determines whether the received ink cartridge identification information is associated with the autogenic identification information stored in the storage unit, and in case of positive determination, the control unit controls to extinguish the light-emitting unit.

Figure 7:
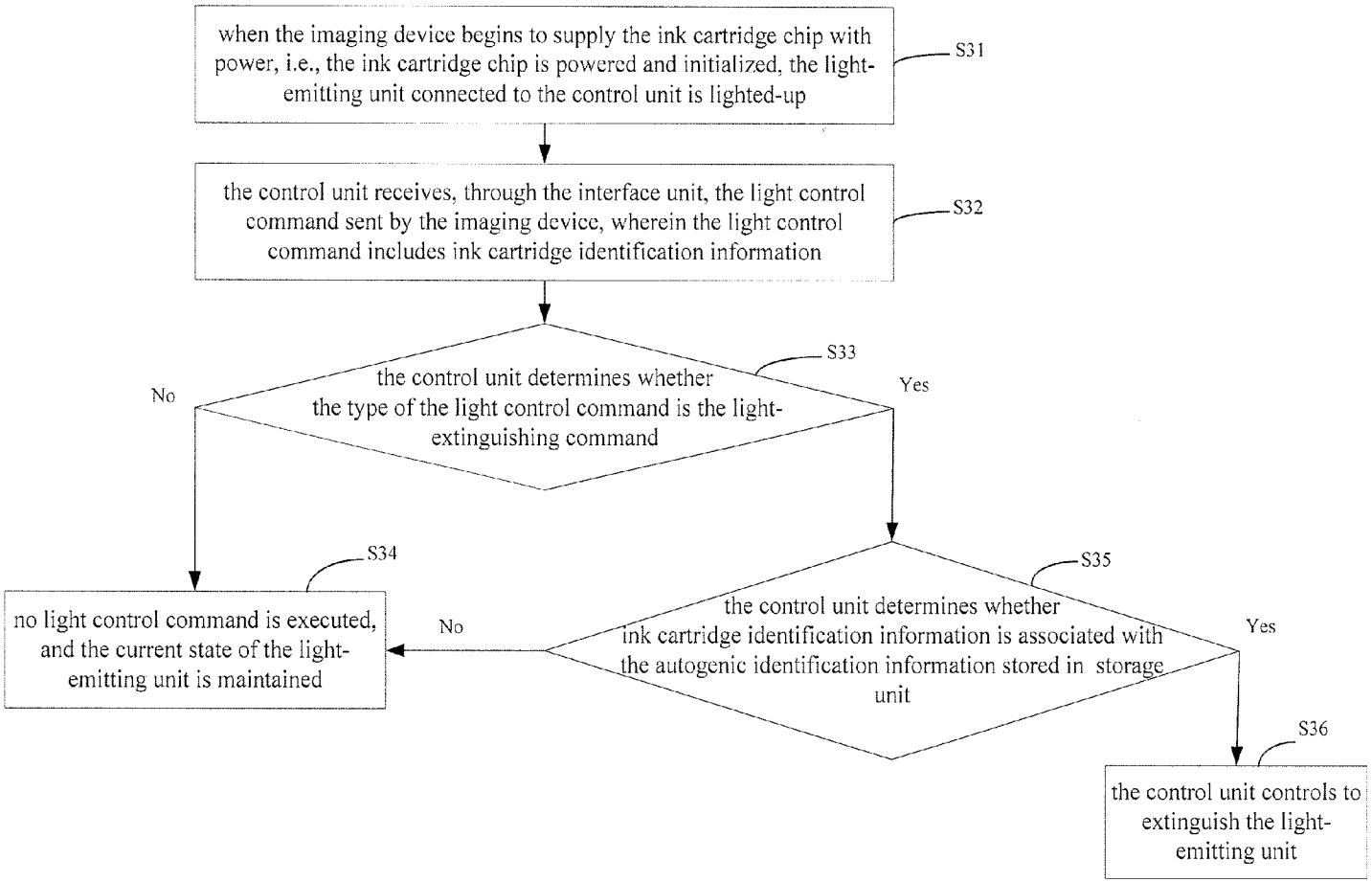
FIG. 7 is a work flowchart of an ink cartridge chip according to a third embodiment of the disclosure.

Referring to FIG. 7, FIG. 7 is a work flowchart of the ink cartridge chip according to the embodiment of the disclosure. The flowchart includes steps S31 to S36.

In step S31, when the imaging device begins to supply the ink cartridge chip with power, i.e., the ink cartridge chip is powered and initialized, the light-emitting unit connected to the control unit is lighted-up.

In step S32, the control unit receives, through the interface unit, the light control command sent by the imaging device, wherein the light control command includes ink cartridge identification information.

In step S33, the control unit determines whether the type of the light control command is the light-extinguishing command, and in case of positive determination, the process proceeds to step S35; in case of negative determination, the process proceeds to step S34.

In step S34, no light control command is executed, and the current state of the light-emitting unit is maintained.

In a case that the current state of the light-emitting unit is being lighted-up, the lighted-up state is maintained; in a case that the current state of the light-emitting unit is being extinguished, the extinguished state is maintained.

In step S35, the control unit determines whether the ink cartridge identification information is associated with the autogenic identification information stored in the storage unit, and in case of positive determination, the process proceeds to step S36; in case of negative determination, the process proceeds to step S34.

In step S36, the control unit controls to extinguish the light-emitting unit.

Apparently, the above work process of the ink cartridge chip requires that the light control command sent by the imaging device must include ink cartridge identification information; however, light control commands sent by imaging devices of various types do not necessarily carry ink cartridge identification information, thus, the following changes may be further made to the ink cartridge chip in the embodiment.

Except for storing the autogenic identification information, the storage unit of the ink cartridge chip at least stores a state flag, wherein the state flag is used to indicate that the ink cartridge chip is in an executable state or in a non-executable state, and the definition and default value setting mode are already described in the first embodiment, which will not be described again here. Unlike in the first embodiment, the state flag in the embodiment is used to indicate that whether the light-extinguishing command is executable.

In addition, after determining that the light control command is the light-lighting-up command, the control unit may control to update the state of the ink cartridge chip based on a preset trigger condition. Specifically, in a case that the ink cartridge identification information included in the light-lighting-up command received by the interface unit is associated with the autogenic identification information stored in the storage unit, the control unit rewrites the state flag in the storage unit, thereby changing the current state of the ink cartridge.

Figure 8:
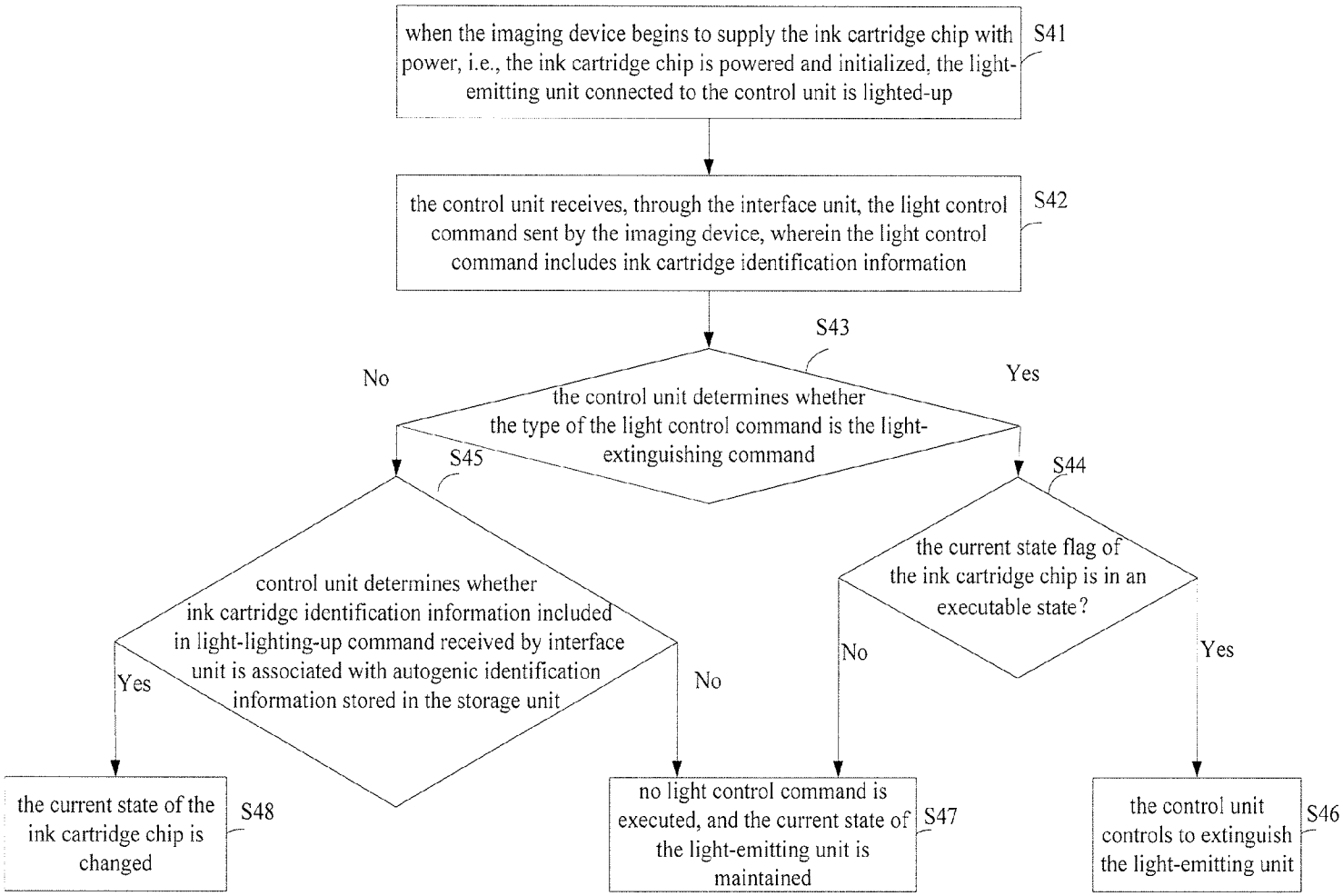
FIG. 8 is a work flowchart of an ink cartridge chip according to the third embodiment of the disclosure.

Referring to FIG. 8, FIG. 8 is the work flowchart of the ink cartridge chip according to the embodiment, wherein the storage unit of the ink cartridge chip stores the state flag. The flowchart includes steps S41 to S48.

In step S41, when the imaging device begins to supply the ink cartridge chip with power, i.e., the ink cartridge chip is powered and initialized, the light-emitting unit connected to the control unit is lighted-up.

In step S42, the control unit receives, through the interface unit, the light control command sent by the imaging device, wherein the light control command includes ink cartridge identification information.

In step S43, the control unit determines whether the type of the light control command is the light-extinguishing command, and in case of positive determination, the process proceeds to step S44; in case of negative determination, the process proceeds to step S45.

In step S44, it is determined whether the current state flag of the ink cartridge chip is in an executable state, and in case of positive determination, the process proceeds to step S46; in case of negative determination, the process proceeds to step S47.

Determining whether the preset extinguishing condition is satisfied includes determining the state of the ink cartridge chip to determine whether to extinguish the light-emitting unit accordingly.

In step S45, the control unit determines whether the ink cartridge identification information included in the light-lighting-up command received by the interface unit is associated with the autogenic identification information stored in the storage unit, and in case of negative determination, the process proceeds to step S47; in case of positive determination, the process proceeds to step S48.

In step S46, the control unit controls to extinguish the light-emitting unit.

In step S47, no light control command is executed, and the current state of the light-emitting unit is maintained.

In step S48, the current state of the ink cartridge chip is changed.

In a case that the current state is the executable state, the state is changed to the non-executable state, and in a case that the current state is the non-executable state, the state is changed to the executable state.

It may be seen that, since the state flag is introduced to the storage unit, the appropriate light-emitting unit of the ink cartridge chip is extinguished precisely based on the ink cartridge identification information included in the light-lighting-up command, even if the received light-extinguishing command does not include the ink cartridge identification information, thus other light-emitting units which should not be extinguished is prevented from being extinguished.

Figure 9:
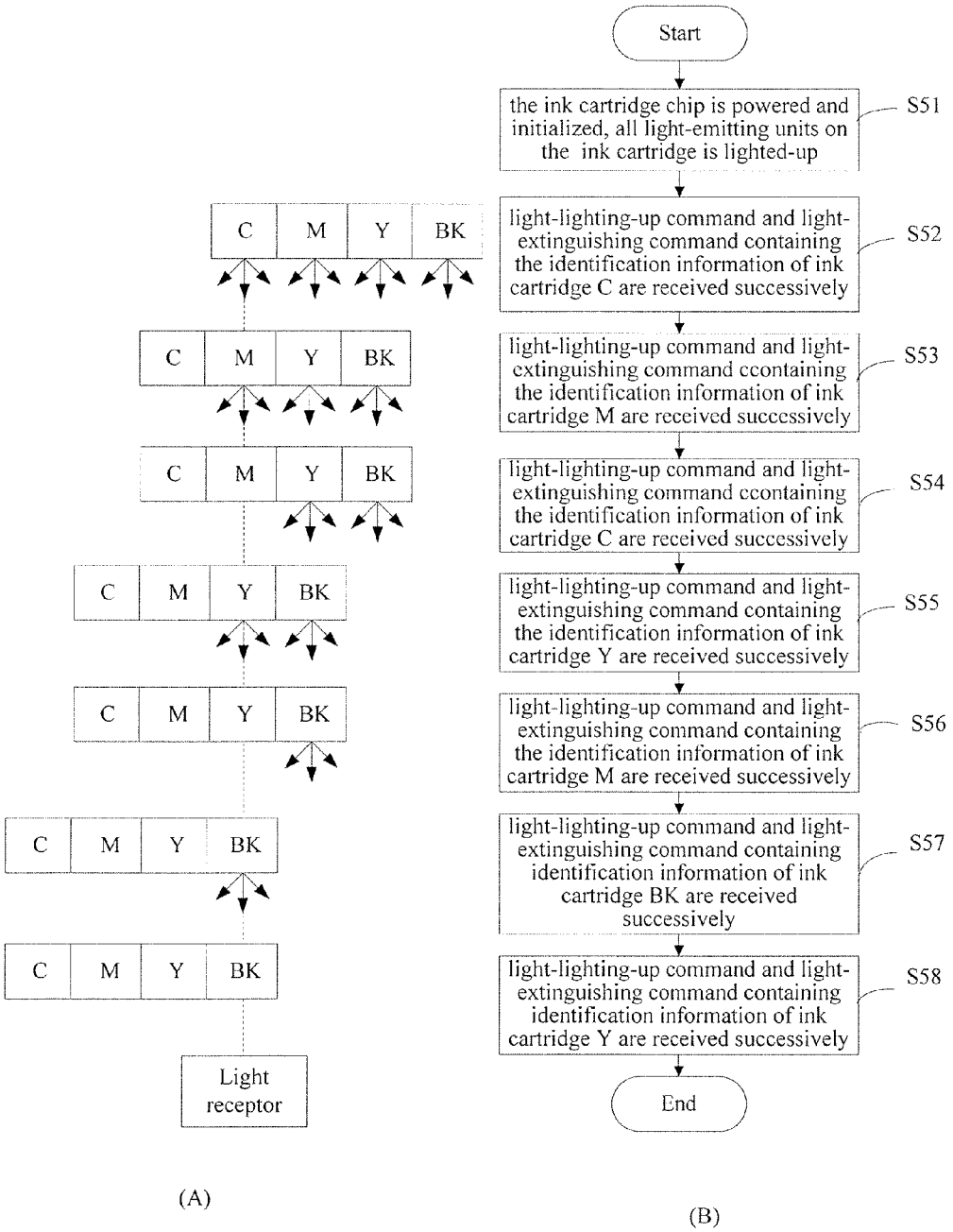
FIG. 9 is a flow chart for detecting location of ink cartridge using the ink cartridge chip according to the third embodiment of the disclosure.

The light control command sent from the imaging device is taken as an example in the following, meanwhile the light control command includes the ink cartridge identification information. Referring to FIG. 9, FIG. 9 is a flow chart for detecting ink cartridge location using the ink cartridge chip according to the third embodiment, and through part (A) and part (B) shown in FIG. 9, advantages of the embodiment are illustrated. It is supposed that the default value of the state flag in the storage unit indicates that the ink cartridge chip is in the non-executable state.

In step S51, when the imaging device begins to supply the ink cartridge chip with power, i.e., the ink cartridge chip is powered and initialized, the light-emitting unit connected to the control unit is lighted-up.

In step S52, the light-lighting-up command and the light-extinguishing command corresponding to the identification information of ink cartridge C are received successively.

The ink cartridge chip receives the light-lighting-up command including the identification information of ink cartridge C sent by the imaging device first, and light-emitting units of all ink cartridges maintain the original light-emitting state. For the ink cartridge chip of which the storage unit stores the state flag, the ink cartridge chip of ink cartridge C changes the state flag, i.e., changes the state of the ink cartridge chip from non-executable state to executable state. After some time, the ink cartridge chip receives the light-extinguishing command including the identification information of ink cartridge C sent by the imaging device. Since the current state of the ink cartridge chip of ink cartridge C is executable state, the preset extinguishing condition is satisfied, the light-extinguishing command can be executed, and the light-emitting unit of ink cartridge C is extinguished (effects of the light-extinguishing command are not shown in FIG. 9); for the ink cartridge chip which at least stores the autogenic identification information, since the ink cartridge identification information is associated with the autogenic identification information stored in the storage unit of ink cartridge C, the preset extinguishing condition is satisfied, the light-emitting unit of ink cartridge C is extinguished. Other ink cartridge chips also receive the light-lighting-up command, but the preset extinguishing condition for extinguishing the light-emitting unit is not satisfied, thus the light-emitting state is maintained.

In step S53, the light-lighting-up command and the light-extinguishing command corresponding to the identification information of ink cartridge M are received successively.

For the light-lighting-up command, the light-emitting unit of ink cartridge C maintains the extinguished state, and all the light-emitting units of ink cartridge M, Y and BK maintain the light-emitting state. For the ink cartridge chip which stores the state flag, the ink cartridge chip of ink cartridge M changes the current state flag, i.e., changes the state of the ink cartridge chip from non-executable state to executable state. For subsequent light-extinguishing commands, the ink cartridge chip of ink cartridge M satisfies the preset extinguishing condition, and the light-emitting unit of ink cartridge M is extinguished, while the light-emitting units of ink cartridge Y and BK maintain the light-emitting state.

In step S54, the light-lighting-up command and the light-extinguishing command corresponding to the identification information of ink cartridge C are received successively.

For the light-lighting-up command, the light-emitting units of ink cartridge C and M maintain the extinguished state, and the light-emitting units of ink cartridge Y and BK maintain the light-emitting state. At this moment the state of the ink cartridge chip of ink cartridge C is meaningless, and at this point the state flag may be changed to change the state of the ink cartridge chip, or the state flag may be set as allowing change for only once (thus the state flag cannot be changed this time). For subsequent light-extinguishing commands, both ink cartridges Y and BK do not satisfy the preset extinguishing condition, and light-emitting units of ink cartridges Y and BK maintain the light-emitting state.

In step S55, the light-lighting-up command and the light-extinguishing command corresponding to the identification information of ink cartridge Y are received successively.

For the light-lighting-up command, the light-emitting units of ink cartridges C and M maintain the extinguished state, and the light-emitting units of ink cartridges Y and BK maintain the light-emitting state. For the ink cartridge chip which stores the state flag, the ink cartridge chip of ink cartridge Y changes the current state flag, i.e., changes the state of the ink cartridge chip from non-executable state to executable state. For subsequent light-extinguishing commands, the ink cartridge chip of ink cartridge Y satisfies the preset extinguishing condition, and the light-emitting unit of ink cartridge Y is extinguished, while the light-emitting unit of ink cartridge BK maintains the light-emitting state.

In step S56, the light-lighting-up command and the light-extinguishing command corresponding to the identification information of ink cartridge M are received successively.

For the light-lighting-up command, the light-emitting units of ink cartridges C, M and Y maintain the extinguished state, and the light-emitting unit of ink cartridge BK maintains the light-emitting state. At this moment the state of the ink cartridge chip of ink cartridge M is meaningless, and at this point the current state flag may be changed to change the state of the ink cartridge chip, or the state flag may be set as allowing change for only once (thus the state flag cannot be changed this time). For subsequent light-extinguishing commands, ink cartridge BK does not satisfy the preset extinguishing condition, and the light-emitting unit of ink cartridge BK maintains the light-emitting state.

In step S57, the light-lighting-up command and the light-extinguishing command corresponding to the identification information of ink cartridge BK are received successively.

For the light-lighting-up command, the light-emitting units of ink cartridge C, M and Y maintain the extinguished state, and the light-emitting unit of ink cartridge BK maintains the light-emitting state. For the ink cartridge chip which stores the state flag, the ink cartridge chip of ink cartridge BK changes the current state flag, to change the state of the ink cartridge chip from non-executable state to executable state. For subsequent light-extinguishing commands, the ink cartridge chip of ink cartridge BK satisfies the preset extinguishing condition, and the light-emitting unit of ink cartridge BK is extinguished. At this time, light-emitting units of all ink cartridges are extinguished.

In step S58, the light-lighting-up command and the light-extinguishing command corresponding to the identification information of ink cartridge Y are received successively.

For the light-lighting-up command, the light-emitting units of ink cartridges C, M, Y and BK maintain the extinguished state. At this moment the state of the ink cartridge chip of ink cartridge Y is meaningless, and at this point the current state flag may be changed to change the state of the ink cartridge chip, or the state flag may be set as allowing change for only once (thus the state flag cannot be changed this time). For subsequent light-extinguishing commands, the light-emitting units of all ink cartridges maintain the extinguished state.

It may be seen that, in the ink cartridge chips and light-emitting control methods thereof in the two solutions according to the embodiment, light-lighting-up commands are not executed, and light-extinguishing commands are selectively executed based on whether the preset condition is satisfied, which achieves the technical effects of the first embodiment: reducing the false alarm rate of the imaging device caused by the manufacturing error of the light-emitting unit or ink cartridge, and avoiding the difficulty for the imaging device to identify incorrect installation of multiple ink cartridges which is the drawback of the solution in which multiple chips are lighted-up or extinguished simultaneously.

The Fourth Embodiment

An ink cartridge chip according to the embodiment, having a structure similar to that in the first embodiment, also includes an interface unit, a control unit, a storage unit, and a light-emitting unit. The connection among and existence forms of respective units of the ink cartridge chip according to the embodiment are the same as those of the ink cartridge chip according to the first embodiment, which will not be described again here, and only the differences are presented.

The storage unit according to the embodiment, at least stores autogenic identification information. Meanwhile, the control unit executes light-lighting-up commands and light-extinguishing commands, and extinguishes the light-emitting unit in a case that the ink cartridge chip receives the light-extinguishing command and the preset extinguishing condition is satisfied.

When receiving the light-lighting-up command sent by the imaging device, without considering the ink cartridge identification information sent along with the command, i.e., without considering which object is to be controlled, the control unit may directly control the light-emitting unit connected to the control unit to emit light, or control the light-emitting unit to emit light after a certain delay. After some time, the imaging device sends the light-extinguishing command, and the control unit determines whether the preset extinguishing condition is satisfied after receiving the light-extinguishing command through the interface unit, i.e., determines whether the ink cartridge identification information sent along with the light control command is associated with the autogenic identification information stored in the storage unit. In case of positive determination, the control unit controls to extinguish the light-emitting unit.

Figure 10:
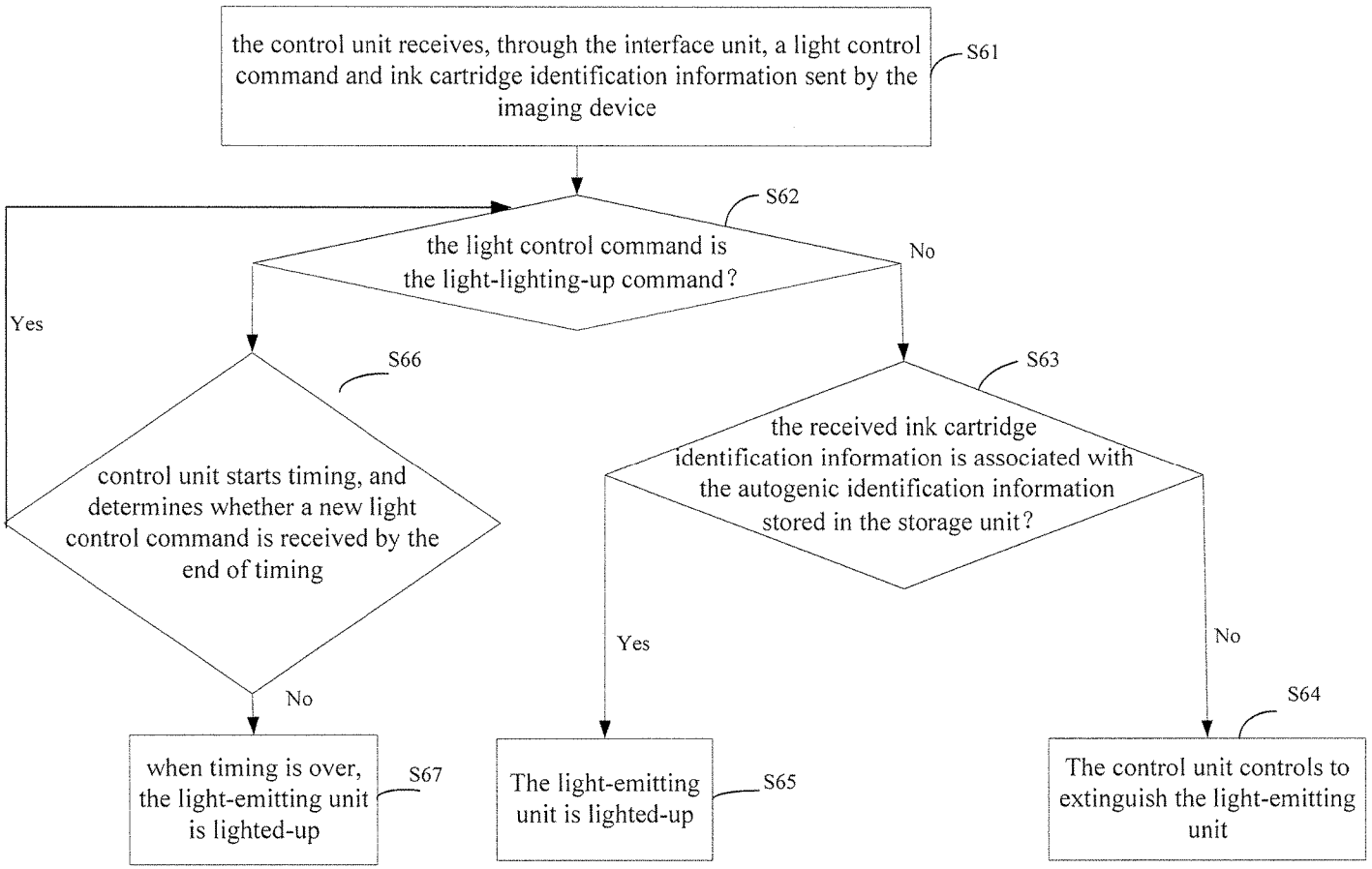
FIG. 10 is a work flowchart of an ink cartridge chip according to a fourth embodiment of the disclosure.

Referring to FIG. 10, FIG. 10 is a work flowchart of the ink cartridge chip according to the embodiment. The flowchart includes steps S61 to S67.

In step S61, the control unit receives, through the interface unit, a light control command and ink cartridge identification information sent by the imaging device.

In step S62, it is determined whether the light control command is the light-lighting-up command; in case of negative determination, the process proceeds to step S63, in case of positive determination, the process proceeds to step S66.

In step S63, the control unit determines whether the received ink cartridge identification information is associated with the autogenic identification information stored in the storage unit; in case of negative determination, the process proceeds to step S64; in case of positive determination, the process proceeds to step S65.

In step S64, no light control command is executed, and the current state of the light-emitting unit is maintained.

In a case that the current state of the light-emitting unit is being lighted-up, the lighted-up state is maintained; in a case that the current state of the light-emitting unit is being extinguished, the extinguished state is maintained.

In step S65, the control unit controls to extinguish the light-emitting unit.

In step S66, the control unit starts timing, and determines whether a new light control command is received by the end of timing, in case of positive determination, the process proceeds to step S62; otherwise, the process proceeds to step S67.

Supposing that the timing ends at point T, in the process from the start of timing to the point when the timing ends at T, the control unit determines whether the new light control command is received; in case of positive determination, the process proceeds to step S62; on the contrary, if no new light control command is received in the process, the process proceeds to step S67.

Considering the differences of response rates among different components and logic circuits in the embodiment, when it is determined that all conditions for lighting-up the light-emitting unit are satisfied, the light-emitting unit may be controlled to be lighted-up directly, or the light-emitting unit may be controlled to be lighted-up after a delay of several clock cycles (for example, any value between 10 ms and 950 ms), and the delay between different ink cartridge chips may be the same, or may be set separately.

In step S67, when timing is over, the light-emitting unit is lighted-up.

When timing reaches T, i.e., when timing is over, the control unit controls to light-up the light-emitting unit, which is equivalent to controlling lighting-up the light-emitting unit after a delay of T.

Apparently, the above work flowchart of ink cartridge chips requires that the light-extinguishing command must include ink cartridge identification information; however, light control commands sent by imaging devices of various types do not necessarily carry ink cartridge identification information, thus, the following changes may be further made to the ink cartridge chip.

Except for storing the autogenic identification information, the storage unit of the ink cartridge chip at least stores a state flag, wherein the state flag is used to indicate that the ink cartridge chip is in an executable state or in a non-executable state, and the definition and default value setting mode are described in the first embodiment, which will not be described again here. Unlike in the first embodiment, the state flag in the embodiment is used to indicate that whether the light-extinguishing command is executable.

In addition, after determining that the light control command is the light-lighting-up command, the control unit may control to update the state of the ink cartridge chip based on a preset trigger condition. Specifically, in a case that the ink cartridge identification information received along with the light-lighting-up command by the interface unit is associated with the autogenic identification information stored in the storage unit, the control unit rewrites the state flag in the storage unit, thereby changing the current state of the ink cartridge chip; when the control unit extinguishes the light-emitting unit, the control unit also rewrites the state flag in the storage unit, thereby changing the current state of the ink cartridge chip. When the control unit receives the light-extinguishing command, and the state of the ink cartridge chip is executable state, the control unit may extinguish the light-emitting unit.

Figure 11:
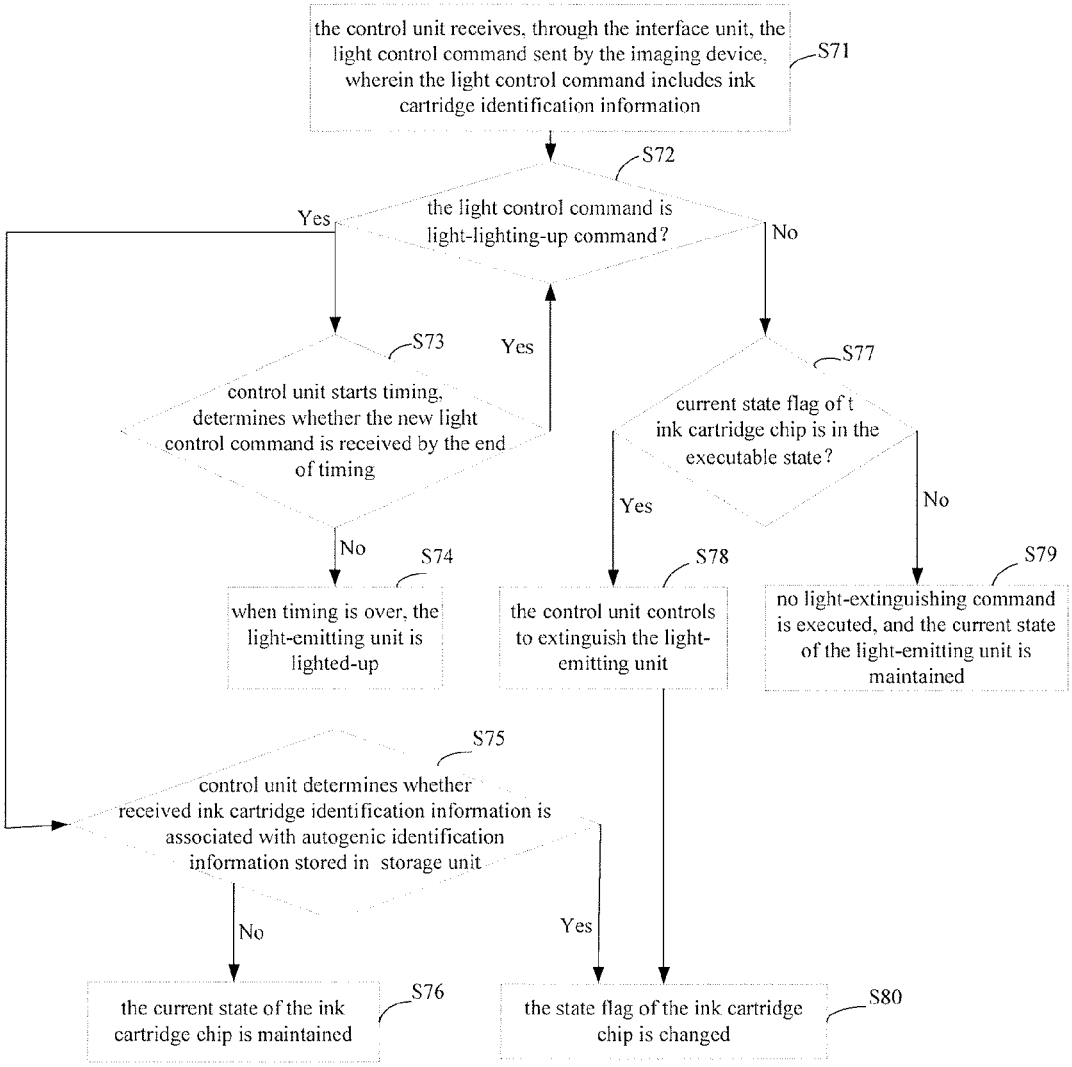
FIG. 11 is a work flowchart of an ink cartridge chip according to the fourth embodiment of the disclosure.

Referring to FIG. 11, FIG. 11 is work flowchart of the ink cartridge chip according to the embodiment of the disclosure. The flowchart includes steps S71 to S80.

In step S71, the control unit receives, through the interface unit, the light control command sent by the imaging device, wherein the light control command includes ink cartridge identification information.

In step S72, it is determined whether the light control command is the light-lighting-up command, in case of positive determination, the process proceeds to steps S73 and S75, otherwise, the process proceeds to step S77.

In step S73, the control unit starts timing, and determines whether the new light control command is received by the end of timing, in case of positive determination, the process proceeds to step S72; otherwise, the process proceeds to step S74.

In a case that the control unit determines the light control command is the light-lighting-up command, the control unit starts timing. Supposing that the timing ends at point T, in the process from the start of timing to the point when the timing ends at T, the control unit determines whether the new light control command is received, in case of positive determination, the process proceeds to step S72; on the contrary, if no new light control command is received in the process, the process proceeds to step S74.

In step S74, when timing is over, the light-emitting unit is lighted-up.

When timing reaches T, i.e., when timing is over, the control unit controls to light-up the light-emitting unit, which is equivalent to controlling lighting-up the light-emitting unit after a delay of T.

In step S75, in a case that the control unit determines that the light control command is the light-lighting-up command, the control unit determines whether the received ink cartridge identification information is associated with the autogenic identification information stored in the storage unit, in case of negative determination, the process proceeds to steps S76; in case of positive determination, the process proceeds to step S80.

In step S76, the current state of the ink cartridge chip is maintained.

In a case that the current state is executable state, the executable state is maintained; in a case that the current state is non-executable state, the non-executable state is maintained.

In step S77, in a case that the control unit determines that the light control command is the light-extinguishing command, the control unit determines whether the current state flag of the ink cartridge chip is in the executable state, in case of positive determination, the process proceeds to step S78; on the contrary, the process proceeds to step S79.

In step S78, the control unit controls to extinguish the light-emitting unit, and the process proceeds to step S80.

In step S79, no light-extinguishing command is executed, and the current state of the light-emitting unit is maintained.

In a case that the current state of the light-emitting unit is being lighted-up, the lighted-up state is maintained; in a case that the current state of the light-emitting unit is being extinguished, the extinguished state is maintained.

In step S80, the state flag of the ink cartridge chip is changed.

In a case that the current state is executable state, the state is changed to non-executable state; in a case that the current state is non-executable state, the state is changed to executable state.

It may be seen that, since the state flag is introduced to the storage unit, the light-emitting unit of the ink cartridge chip is extinguished precisely using ink cartridge identification information included in the light-lighting-up command, even if no ink cartridge identification information is included in the light-extinguishing command, and other light-emitting units which should not be extinguished is prevented from being extinguished.

Both the ink cartridge chips and light-emitting control methods thereof in the embodiment achieve the technical effects of the first embodiment: reducing the false alarm rate of the imaging device caused by the manufacturing error of the light-emitting unit or ink cartridge, and avoiding the difficulty for the imaging device to identify incorrect installation of multiple ink cartridges which is the drawback of the solution in which multiple chips are lighted-up or extinguished simultaneously.

In addition, an ink cartridge is further provided according to the disclosure. The ink cartridge includes at least one ink cartridge chip according to above embodiments, wherein all the ink cartridge chips of the ink cartridge may be connected to the imaging device through a same communication bus, and receive light control commands sent from the imaging device. Besides, an ink cartridge is further provided according to the disclosure, the ink cartridge may include the interface unit, control unit and storage unit which are not integrated in the ink cartridge chip, and working principles and control methods of the interface unit, control unit and storage unit included in the ink cartridge are the same as those of the interface unit, control unit and storage unit which are integrated in the ink cartridge chip in above respective embodiments. Specifically, the ink cartridge includes the interface unit, control unit and storage unit. The interface unit is configured to receive light control commands sent from the imaging device, and the light control command includes ink cartridge identification information; the storage unit is configured to store the autogenic identification information and state flag, and the state flag includes an executable state or a non-executable state; the control unit is connected to any light-emitting unit, and is configured to execute the light control command, wherein the type of the light control command includes the light-lighting-up command or the light-extinguishing command; the control unit is connected to the interface unit and storage unit, and is configured to, when the interface unit receives the light control command, control the light-emitting unit to execute the light control command based on the type of the light control command and the state flag in the storage unit; after the light-emitting unit executes the light control command, to re-determined the state flag based on the association relationship between the ink cartridge identification information and the autogenic identification information.

The following cases, which are briefly introduced blow, also apply to all the above embodiments, but do not limit the scope of the above embodiments.

1. Light-Up after a Delay

Considering the differences of response rates among different components and logic circuits, if it is determined that all conditions for lighting-up the light-emitting unit are satisfied, the light-emitting unit may be controlled to be lighted-up directly, or the light-emitting unit may be controlled to be lighted-up after a delay of several clock cycles (for example, any value between 10 ms and 950 ms), and the delay between different ink cartridge chips may be the same, or may be set separately.

2. Process when Opening Protection Cover

When it requires to change the ink cartridge or it is found the installation of the ink cartridge is abnormal, the user needs to open the protection cover on the imaging device for related maintenance, and the ink cartridge is installed under the protection cover. In above embodiments, after the imaging device finishes the light detection, and the ink cartridge chip does not release the control to the light-emitting unit, since the lighted-up light-emitting units in above respective solutions are not able to correspond to respective pieces of ink cartridge identification information, it is prone to mislead the user when the imaging device prompts the user for the ink cartridge fault or other situations through the light-emitting unit. Since the light control command (for example, the foregoing flickering light-lighting-up command) sent when the imaging device with an opened protection cover feeds back the state of the ink cartridge chip to the user through the flicker of the light-emitting unit is usually different from the light control command (for example, the foregoing always-lighting light-lighting-up command) sent when the imaging device performs the light detection on the ink cartridge, the ink cartridge chip may be set not to execute the light control command sent when the protection cover of the imaging device is opened, i.e., to control the light-emitting unit not to emit light, avoiding misleading the user. Conventional imaging devices are usually equipped with a display screen, and the user may confirm the status of the ink cartridge and the ink cartridge chip through the display screen.

3. Ink Cartridge Adapter

Figure 12:
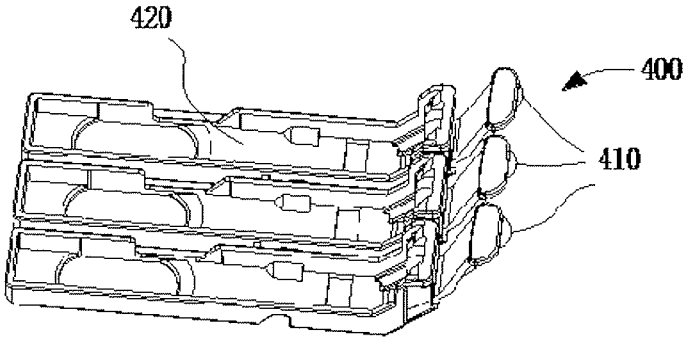
FIG. 12 is a structure diagram of an ink cartridge adapter.

As shown in FIG. 12, which is a structure diagram of an ink cartridge adapter, the control unit and the storage unit of the ink cartridge chip may be provided together with multiple light-emitting units 410 on an adapter 400, the adapter 400 is provided between the ink cartridge and the main body of the imaging device, and a space 420 accommodating for multiple ink cartridges is provided on the adapter 400, i.e., first the adapter 400 is installed on the main body of the imaging device, then multiple ink cartridges are installed on the adapter 400, at this time, respective light-emitting units 410 correspond to the multiple installed ink cartridges one-to-one. The functions of the respective foregoing ink cartridge chips may be integrated on the adapter, and each light-emitting unit is controlled by the corresponding control unit, or all the light-emitting units are controlled by one control unit. Respective light-emitting units correspond to the storage units storing different ink cartridge identification information one-to-one, and the light-emitting units corresponding to the storage units are controlled to emit light according to the control method in the above embodiment, based on different control methods in the above respective embodiments.

In FIG. 12, multiple ink cartridges may be installed on the ink cartridge adapter 400, the number of control units, storage units and light-emitting units on the ink cartridge adapter 400 may be the same, and there is one-to-one correspondence relationship among the control units, storage units and light-emitting units. The control unit is connected to the interface unit and the storage unit corresponding to the control unit, and is configured to, when the interface unit receives the light control command, control the light-emitting unit corresponding to the control unit to execute the light control command based on the type of the light control command and the state flag in the storage unit; after the light-emitting unit executes the light control command, to re-determined the state flag based on the association relationship between the ink cartridge identification information and the autogenic identification information.

Alternatively, units with the same function may be integrated, and the ink cartridge adapter 400 includes only one interface unit, only one control unit, only one storage unit and at least one light-emitting unit. The control unit, is specifically configured to, when the interface unit receives the light control command, control the light-emitting unit corresponding to the light control command to execute the light control command based on the type of the light control command and the state flag in the storage unit; after the light-emitting unit executes the light control command, to re-determined the state flag based on the association relationship between the ink cartridge identification information and the autogenic identification information. Since multiple light-emitting units are configured based on the number of ink cartridges which can be installed on the adapter, the light-emitting units may correspond to respective pieces of ink cartridge identification information, and then the light-emitting unit corresponding to the light control command may be confirmed through the ink cartridge identification information included in the light control command.

In addition, different from the ink cartridge adapter in FIG. 12, the ink cartridge adapter may be provided for one single ink cartridge, i.e., only one ink cartridge can be installed on such ink cartridge adapter, and such ink cartridge adapter may include the interface unit, at least one control unit, at least one storage unit and at least one light-emitting unit. The difference from the ink cartridge chip in the foregoing embodiments is that, for the ink cartridge chip, the interface unit, control unit, storage unit and light-emitting unit are usually provided on one printed circuit board, while for the ink cartridge adapter, the interface unit, control unit, storage unit and light-emitting unit are provided on one structure and probably are not on one printed circuit board.

4. Use a Match Counter to Control Whether to Execute the Light-Extinguishing Command Similar to the match counter mentioned in the second embodiment, for the approach of executing the light-extinguishing command adopted in the third embodiment and fourth embodiment, the ink cartridge chip may be set, based on the discipline with which the imaging device sends the light control command, to execute the operation of extinguishing the light-emitting unit in a case that a specific light-extinguishing command is received. For example, the match counter is configured to count the number of times the light control command associated with the autogenic identification information in the storage unit is received. In a case that the control unit finds the match counter counts to a specific preset value, the received light-extinguishing command may be executed, and in a case that the match counter does not count to the preset value or counts to a value beyond the preset value, the received light-extinguishing command cannot be executed. Similarly, the reset mode of the match counter is to recover or reset to zero when the ink cartridge chip is powered for initialization or is powered down.

Those skilled in the art may understand that all or some of the steps according to above method embodiments may be accomplished through program commands or related hardware. The foregoing program may be stored in a computer readable storage medium. When the program is executed, steps including the above method embodiments are executed; the foregoing storage medium includes various medium that may store program codes, such as ROM, RAM, disk or compact disc.

For apparatus embodiments, which basically correspond to method embodiments, the relevance refers to partial description of method embodiments. The above apparatus embodiments are only illustrative, wherein the units described as separate parts may be or may not be physically separated, and the parts displayed as units may be or may not be physical units, i.e., the units and parts may be located in one place, or may be distributed to multiple network units. Parts or all of the modules may be chosen based on actual needs to realize the objective of the solution according to the embodiment. Those skilled in the art may understand and implement the solution without any creative work.

It should be noted that, in the disclosure, relational terms such as the first and the second are only configured to distinguish an entity or operation from another entity or operation, and it does not necessarily require or imply that there are such actual relationships or sequences among the entities or operations. Furthermore, the term 'include', 'comprise' or any other variant thereof intends to cover a non-exclusive inclusion, thus allows a process, a method, an object or an apparatus including a series of elements to include not only the elements, but also other elements not clearly set out, or to include intrinsic elements of the process, method, object or apparatus. In a case that there are no more restrictions, elements defined by the statement 'include a . . . ' do not exclude the case that other similar elements exist in the process, method, object or apparatus including the elements.

Ink cartridge chips, ink cartridges and ink cartridge adapters according to the embodiments of the disclosure are described above in detail, specific examples are used to illustrate the principle and execution mode of the disclosure, and the above description of the embodiments are used to help understand the methods of the disclosure and core ideas thereof; meanwhile, those skilled in the art, based on the ideas of the disclosure, may conceive changes to the specific execution mode and application range. In conclusion, the contents of the disclosure should not be understood as limitations to the disclosure.

The invention claimed is:

1. An ink cartridge chip applied in an ink cartridge, wherein the ink cartridge is detachably installed in an imaging device, and the ink cartridge chip comprises an interface unit and a control unit, wherein:

the interface unit is configured to receive a light control command sent from the imaging device, and a type of the light control command comprises a light-lighting-up command or a light-extinguishing command;

the control unit is connected to a light-emitting unit, and is configured to light up the light-emitting unit on detecting that the ink cartridge chip is in a power-up initialization stage; and the control unit is connected to the interface unit, and is configured to determine, in a case that the light control command received by the interface unit is a light-extinguishing command, whether a preset extinguishing condition is satisfied, extinguish the light-emitting unit in a case that the preset extinguishing condition is satisfied, and maintain a current state of the light-emitting unit in a case that the light control command received by the interface unit is a light-lighting-up command.

2. The ink cartridge chip according to claim 1, wherein:

the light control command comprises ink cartridge identification information;

the ink cartridge chip further comprises a storage unit configured to store autogenic identification information, wherein the autogenic identification information is information to distinguish different ink cartridge types; and the control unit is also connected to the storage unit, and is configured to determine, in a case that the light control command received by the interface unit is a light-extinguishing command, whether the ink cartridge identification information in the light control command is associated with the autogenic identification information in the storage unit, extinguish the light-emitting unit in a case that the ink cartridge identification information is associated with the autogenic identification information in the storage unit, and maintain the current state of the light-emitting unit in a case that the light control command received by the interface unit is a light-lighting-up command.

3. An ink cartridge, wherein the ink cartridge is detachably installed in an imaging device and comprises the ink cartridge chip according to claim 2.

4. The ink cartridge chip according to claim 1, wherein:

the ink cartridge chip further comprises a storage unit configured to store a state flag, wherein the state flag indicates an executable state or a non-executable state; and accordingly, the control unit is configured to determine, in a case that the light control command received by the interface unit is a light-extinguishing command, whether the state flag indicates the executable state, extinguish the light-emitting unit in a case that the state flag indicates the executable state, and maintain the current state of the light-emitting unit in a case that the light control command received by the interface unit is a light-lighting-up command.

5. The ink cartridge chip according to claim 4, wherein:

the light control command comprises ink cartridge identification information;

the storage unit is further configured to store autogenic identification information, wherein the autogenic identification information is information to distinguish different ink cartridge types; and accordingly, the control unit is further configured to determine, in a case that the light control command received by the interface unit is a light-lighting-up command, whether the ink cartridge identification information in the light control command is associated with the autogenic identification information in the storage unit, and change the state flag in the storage unit in a case that the ink cartridge identification information in the light control command is associated with the autogenic identification information in the storage unit.

6. An ink cartridge, wherein the ink cartridge is detachably installed in an imaging device and comprises the ink cartridge chip according to claim 5.

7. An ink cartridge, wherein the ink cartridge is detachably installed in an imaging device and comprises the ink cartridge chip according to claim 4.

8. An ink cartridge, wherein the ink cartridge is detachably installed in an imaging device and comprises the ink cartridge chip according to claim 1.

9. An ink cartridge chip applied in an ink cartridge, wherein the ink cartridge is detachably installed in an imaging device, and the ink cartridge chip comprises an interface unit and a control unit, wherein:

the interface unit is configured to receive a light control command sent from the imaging device, and a type of the light control command comprises a light-lighting-up command or a light-extinguishing command;

the control unit is connected to a light-emitting unit; and the control unit is connected to the interface unit, and is configured to determine, in a case that the light control command received by the interface unit is a light-extinguishing command, whether a preset extinguishing condition is satisfied, extinguish the light-emitting unit in a case that the preset extinguishing condition is satisfied, start timing in a case that the light control command received by the interface unit is a light-lighting-up command, and light up the light-emitting unit in a case that the interface unit receives no new light control command by the end of the timing.

10. The ink cartridge chip according to claim 9, wherein:

the light control command comprises ink cartridge identification information;

the ink cartridge chip further comprises a storage unit configured to store autogenic identification information, wherein the autogenic identification information is information to distinguish different ink cartridge types; and the control unit is also connected to the storage unit, and is configured to determine, in a case that the light control command received by the interface unit is a light-extinguishing command, whether the ink cartridge identification information in the light control command is associated with the autogenic identification information in the storage unit, extinguish the light-emitting unit in a case that the ink cartridge identification information is associated with the autogenic identification information in the storage unit, start timing in a case that the light control command received by the interface unit is a light-lighting-up command, and light up the light-emitting unit in a case that the interface unit receives no new light control command by the end of the timing.

11. An ink cartridge, wherein the ink cartridge is detachably installed in an imaging device and comprises the ink cartridge chip according to claim 10.

12. The ink cartridge chip according to claim 9, wherein:

the ink cartridge chip further comprises a storage unit configured to store a state flag, wherein the state flag indicates an executable state or a non-executable state; and accordingly, the control unit is configured to determine, in a case that the light control command received by the interface unit is a light-extinguishing command, whether the state flag indicates the executable state, extinguish the light-emitting unit in a case that the state flag indicates the executable state, start timing in a case that the light control command received by the interface unit is a light-lighting-up command, and light up the light-emitting unit in a case that the interface unit receives no new light control command by the end of the timing.

13. The ink cartridge chip according to claim 12, wherein;

the light control command comprises ink cartridge identification information;

the storage unit is further configured to store autogenic identification information, wherein the autogenic identification information is information to distinguish different ink cartridge types; and accordingly, the control unit is further configured to determine, in a case that the light control command received by the interface unit is a light-lighting-up command, whether the ink cartridge identification information in the light control command is associated with the autogenic identification information in the storage unit, and change the state flag in the storage unit in a case that the ink cartridge identification information in the light control command is associated with the autogenic identification information in the storage unit.

14. An ink cartridge, wherein the ink cartridge is detachably installed in an imaging device and comprises the ink cartridge chip according to claim 13.

15. An ink cartridge, wherein the ink cartridge is detachably installed in an imaging device and comprises the ink cartridge chip according to claim 12.

16. An ink cartridge, wherein the ink cartridge is detachably installed in an imaging device and comprises the ink cartridge chip according to claim 9.

17. An ink cartridge adapter, wherein the ink cartridge adapter is detachably installed in an imaging device and comprises an interface unit, at least one control unit and at least one light-emitting unit, wherein:

the interface unit is configured to receive a light control command sent from the imaging device, and a type of the light control command comprises a light-lighting-up command or a light-extinguishing command;

the at least one control unit is connected to the at least one light-emitting unit, and is configured to light up the at least one light-emitting unit on detecting that the ink cartridge adapter is in a power-up initialization stage; and the at least one control unit is connected to the interface unit, and is configured to determine, in a case that the light control command received by the interface unit is a light-extinguishing command, whether a preset extinguishing condition is satisfied, extinguish the at least one light-emitting unit in a case that the preset extinguishing condition is satisfied, and maintain a current state of the at least one light-emitting unit in a case that the light control command received by the interface unit is a light-lighting-up command.

18. The ink cartridge adapter according to claim 17, wherein:

the light control command comprises ink cartridge identification information;

the ink cartridge adapter further comprises a storage unit configured to store autogenic identification information, wherein the autogenic identification information is information to distinguish different ink cartridge types; and the at least one control unit is also connected to the storage unit, and is configured to determine, in a case that the light control command received by the interface unit is a light-extinguishing command, whether the ink cartridge identification information in the light control command is associated with the autogenic identification information in the storage unit, extinguish the at least one light-emitting unit in a case that the ink cartridge identification information is associated with the autogenic identification information in the storage unit, and maintain the current state of the at least one light-emitting unit in a case that the light control command received by the interface unit is a light-lighting-up command.

19. The ink cartridge adapter according to claim 17, wherein:

the ink cartridge adapter further comprises a storage unit configured to store a state flag, wherein the state flag indicates an executable state or a non-executable state; and accordingly, the at least one control unit is configured to determine, in a case that the light control command received by the interface unit is a light-extinguishing command, whether the state flag indicates the executable state, extinguish the at least one light-emitting unit in a case that the state flag indicates the executable state, and maintain the current state of the at least one light-emitting unit in a case that the light control command received by the interface unit is a light-lighting-up command.

20. The ink cartridge adapter according to claim 19, wherein:

the light control command comprises ink cartridge identification information;

the storage unit is further configured to store autogenic identification information, wherein the autogenic identification information is information to distinguish different ink cartridge types; and accordingly, the at least one control unit is further configured to determine, in a case that the light control command received by the interface unit is a light-lighting-up command, whether the ink cartridge identification information in the light control command is associated with the autogenic identification information in the storage unit, and change the state flag in the storage unit in a case that the ink cartridge identification information in the light control command is associated with the autogenic identification information in the storage unit.

* * * * *